US010006184B2

(12) United States Patent
Sharp et al.

(10) Patent No.: US 10,006,184 B2
(45) Date of Patent: Jun. 26, 2018

(54) AUTOMATED DYNAMIC COMPACTION SYSTEM

(71) Applicants: Trimble Navigation Limited, Sunnyvale, CA (US); Bejing New Airport Construction Headquarters, Beijing (CN)

(72) Inventors: Alan Sharp, Superior, CO (US); Morgan Mattsson, Trollhättan (SE); Ole Martin Gausnes, Heimdal (NO); Logan Rowe, Westminster, CO (US); Qiang Li, Beijing (CN); Zhibin Gao, Beijing (CN); Jiaguang Dong, Beijing (CN); Shaoning Liu, Beijing (CN)

(73) Assignee: Trimble Inc., Sunnyvale, CA (US)

( * ) Notice: Subject to any disclaimer, the term of this patent is extended or adjusted under 35 U.S.C. 154(b) by 144 days.

(21) Appl. No.: 15/093,960

(22) Filed: Apr. 8, 2016

(65) Prior Publication Data

US 2017/0241097 A1 Aug. 24, 2017

(30) Foreign Application Priority Data

Feb. 18, 2016 (CN) ..... 2016 1 0091312

(51) Int. Cl.
*B66D 1/44* (2006.01)
*E02D 3/046* (2006.01)
*E01C 19/34* (2006.01)

(52) U.S. Cl.
CPC ..... *E02D 3/046* (2013.01); *E01C 19/34* (2013.01)

(58) Field of Classification Search
CPC ..... E01C 19/34; E02D 3/046; E02D 7/08; E02D 5/22; B09B 1/00; B09B 1/008; B66D 1/44; E02C 5/22
USPC ..... 405/258.1, 271
See application file for complete search history.

(56) References Cited

U.S. PATENT DOCUMENTS 3,971,008 A * 7/1976 Nishizaki ..... B66C 23/905 212/278
4,580,765 A * 4/1986 Nicholson ..... E02D 3/046 173/87
5,826,666 A * 10/1998 Tozawa ..... E02F 3/437 172/7

(Continued)

FOREIGN PATENT DOCUMENTS

JP 2006097398 A * 4/2006

*Primary Examiner* — Stephen Holwerda
(74) *Attorney, Agent, or Firm* — Swanson & Bratschun, L.L.C.

(57) ABSTRACT

A system for automated dynamic compaction includes a compaction crane having a boom and compaction weight, at least one positional sensor, at least one boom deflection sensor, a rotational encoder, and a compaction control system. The compaction control system may be programmed to identify a first drop location having a first target parameter, determine whether the compaction crane is positioned over the first drop location, determine an initial elevation of the compaction weight, lift the compaction weight to a drop height, detect that the compaction weight has been released, re-hoist the compaction weight to the drop height, measure the payout length of a winch cable after each drop, determine a current elevation of the compaction weight after each drop, and determine whether the first target parameter has been satisfied.

20 Claims, 8 Drawing Sheets

(56) References Cited

U.S. PATENT DOCUMENTS

| | | | | |
|---|---|---|---|---|
| 6,505,998 | B1 * | 1/2003 | Bullivant | E02D 1/00 405/271 |
| 2005/0152750 | A1 * | 7/2005 | Morizot | E02D 3/02 405/271 |
| 2007/0025815 | A1 * | 2/2007 | Sick | E01C 19/004 404/84.1 |

* cited by examiner

300

400A

400C

AUTOMATED DYNAMIC COMPACTION SYSTEM

CROSS-REFERENCES TO RELATED APPLICATIONS

The application claims priority, under the provisions of the Paris Convention, 35 U.S.C. § 119(a)-(d), to Chinese Patent Application No. 201610091312.7 filed Feb. 18, 2016, by Sharp et al. and titled, "Automated Dynamic Compaction System" which is hereby incorporated by reference, as if set forth in full in this document, for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to dynamic compaction, and more particularly to a system for the remote management and tracking of dynamic compaction operations.

BACKGROUND

Conventionally, soil compaction techniques are often utilized to create surfaces to support building foundations, roadways, and retaining structures. It is desirable to have consistent and level compacted soil. Many methods are available for soil compaction, such as static compaction, dynamic compaction, and vibrating compaction. Static compaction may include placing a compaction weight on the area requiring compaction, and leaving the compaction weight in place for a certain period of time. Dynamic compaction involves lifting a compaction weight into position, and repeatedly dropping the compaction weight onto the desired location. Vibrating compaction involves stressing a location to be compacted through vibratory movement of a hammer or plate.

Typical operation of a conventional dynamic compaction deployment begins with the manual layout of an operational grid over the construction site. The operational grid may include a plurality of drop locations over which the compaction weight is to be dropped. Standard techniques for marking the drop locations may include the positioning of sandbags over the drop locations as measured and positioned by hand or by using handheld satellite navigation receivers. Once the drop locations have been marked by the placement of sandbags, the compaction machines are navigated manually by an operator to the marked drop location, and the compaction weight placed on the ground at the drop location. Compaction machines typically include mobile cranes with a telescoping boom, which is used to hoist, move, and drop the compaction weight.

The initial elevation of the drop location, or alternatively the initial elevation of the compaction weight, is then determined through manual measurement by using an optical level and staff. The weight is then reattached to a winch cable of the compaction machine and lifted to a predetermined drop height. Once in position, the operator releases the compaction weight, dropping the compaction weight repeatedly for at least a minimum number of drops. Drop-to-drop displacement, total ground displacement, and target displacements are similarly measured and recorded manually. Using this conventional methodology, absolute elevations are not utilized and all data is captured relative to the initial elevation of the drop location or alternatively the initial elevation of the compaction weight.

Due to user error and inconsistencies introduced by the process of manually positioning the compaction weight, and measuring ground displacement, conventional dynamic compaction processes result in errors and non-uniform compaction results between drop locations of the operational grid. Moreover, conventional operating procedures for dynamic compaction pose risks to operators and contractors on the ground during initial positioning of the compaction weight. For example, because compaction weights themselves often have a radius in excess of 1 m, and are carried between points close to the ground, the sand bag marking a drop location may be obscured to the operator by the compaction weight, resulting in errors in the positioning of the compaction weight. In some cases, a contractor on the ground may act as a spotter to assist the operator in navigating and aligning the compaction weight over the sand bag. However, this may expose the spotter to risk of injury, and does not necessarily eliminate alignment error. Additional error and safety risks are introduced in the manual measurement of drop-to-drop ground displacement, and total ground displacement. Furthermore, efficiency and productivity are limited by the time it takes to manually layout and mark the drop locations of an operational grid, navigate to a drop location, align the compaction weight over the drop location marker, and measure ground displacement for each drop.

Thus, an improved system for dynamic compaction is presented by the embodiments below.

BRIEF SUMMARY

According to a set of embodiments, system, apparatus, and methods for dynamic compaction are provided.

The tools provided by various embodiments include, without limitation, methods, systems, and/or software products. Merely by way of example, a method might comprise one or more procedures, any or all of which are executed by a computer system. Correspondingly, an embodiment might provide a computer system configured with instructions to perform one or more procedures in accordance with methods provided by various other embodiments. Similarly, a computer program might comprise a set of instructions that are executable by a computer system (and/or a processor therein) to perform such operations. In many cases, such software programs are encoded on physical, tangible, and/or non-transitory computer readable media (such as, to name but a few examples, optical media, magnetic media, and/or the like).

In an aspect, a system for dynamic compaction is provided. The system may include a compaction crane having a boom and compaction weight. The compaction weight may have a proximal and distal end, the boom operatively coupled to a housing assembly at the proximal end. The compaction weight may be hitched to a distal end of the boom via a winch cable. The system may further include at least one positional sensor operatively coupled to the compaction crane to determine at least a position of the distal end of the boom, at least one boom deflection sensor operatively coupled to the distal end of the boom to determine at least a boom deflection of the distal end, a rotational encoder tracking a payout length of the winch cable, a pressure sensor communicatively coupled to a hydraulic line of a boom lifting system, and a compaction control system. In various embodiments, the compaction control system may be in communication with each of the at least one positional sensor, the at least one boom deflection sensor, the rotational encoder, and the pressure sensor. The compaction control system may include at least one processor, and non-transitory computer readable media having encoded thereon computer software comprising a set of instructions. The set of instructions may be executable by the at least one processor to identify a first drop location of a plurality of drop locations, the first drop location associated with a first target parameter. The compaction control system may then determine, via the at least one positional sensor, whether at least one of the distal end of the boom or the compaction weight is positioned over the first drop location. An initial elevation of the compaction weight at rest at the first drop location may be determined via the rotational encoder, and the compaction weight may be lifted to a desired drop height associated with the first drop location via the winch cable. After being lifted to the drop height, the compaction weight may be dropped onto the drop location. The compaction control system may then detect, via at least one of the at least one boom deflection sensor or pressure sensor, that the compaction weight has been released. The compaction weight may be re-hoisted, via the winch cable, the drop height. While the compaction weight is being re-hoisted, the rotational encoder may be used to measure the payout length of the winch cable when the compaction weight initially lifts off the ground. Based on the payout length, the a current elevation of the compaction weight may be determined. After each drop, the compaction control system may determine whether a first target parameter has been satisfied.

According to a set of embodiments, the system may further include a site gateway communicatively coupled to the compaction control system, the site gateway connecting the compaction control system to a communications network. The compaction control system may further include instructions executable by the at least one processor to receive at least one updated dynamic compaction plan parameter, wherein the at least one updated dynamic compaction plan parameter effects a change to at least one of the first target parameter, or a position of at least one of the plurality of drop locations. Correspondingly, the compaction control system may further be able to transmit at least one of the position of the distal end of the boom, the boom deflection of the distal end, a distal end elevation, the payout length of the winch cable, or a line pressure of the hydraulic line. Further embodiments may utilize a friction drive depth sensor operatively coupled to a winch wheel around which the winch cable is wound as the rotational encoder.

In one set of embodiments, the system may further include at least one global navigation satellite system receiver, wherein the at least one global navigation satellite system receiver further comprises the at least one positional sensor and the at least one boom deflection sensor, the at least one global navigation satellite system receiver in communication with at least one global navigation satellite system antenna operatively coupled to the housing assembly of the compaction crane, and at least one global navigation satellite system antenna operatively coupled to the distal end of the boom. In further embodiments, the compaction control system may further include instructions executable by the at least one processor to identify, via the pressure sensor, when the compaction weight initially lifts off the ground based on a line pressure of the hydraulic line, identify, via the at least one boom deflection sensor, when the compaction weight initially lifts off the ground based on the boom deflection of the distal end, and determine, based at least in part on at least one of the line pressure or boom deflection, a trigger point to measure the payout length from which the current elevation of the compaction weight is determined. In some embodiments, the compaction control system may further include instructions executable by the at least one processor to determine, via the at least one boom deflection sensor, the boom deflection, wherein the boom deflection indicates an amount of vertical displacement of the distal end of the boom, and determine, via the at least one positional sensor, a distal end elevation at the trigger point.

According to a further set of embodiments, the compaction control system may further include instructions executable by the at least one processor to determine a total drop count of compaction weight drops, wherein a compaction weight drop is only counted when a lift cycle has been completed for the compaction weight and the current elevation of the compaction weight is lower than the initial elevation. In some embodiments, the compaction weight drop may only be counted when further the drop height exceeds a threshold value above the initial elevation.

In another set of embodiments, the compaction control system may further include instructions executable by the at least one processor to determine, based at least in part on the current elevation of the compaction weight, a second compaction weight of a plurality of compaction weights to use in a subsequent drop, and identify, via at least one of the pressure sensor or the at least one boom deflection sensor, which of the plurality of compaction weights is being hoisted. In a set of embodiments, the instructions may further be executable by the at least one processor to automatically navigate, based on the at least one positional sensor, the compaction crane to a location proximate to the first drop location, and automatically position, via the housing assembly and boom lifting system, the distal end of the boom over the first drop location. In various embodiments, the target parameter includes at least one of a minimum drop count, maximum drop count, total drop count, drop-to-drop elevation change, target elevation, or total elevation change. Some embodiments may provide for the initial and current elevations to be measured from one of a top or bottom surface of the compaction weight.

In another aspect, a dynamic compaction controller is provided in communication with at least one positional sensor, at least one boom deflection sensor, a rotational encoder, and a pressure sensor. The compaction control system may further include at least one processor, and non-transitory computer readable media having encoded thereon computer software comprising a set of instructions. The set of instructions may be executable by the at least one processor to identify a first drop location of a plurality of drop locations, the first drop location associated with a first target parameter. The dynamic compaction controller may then determine, via the at least one positional sensor, whether at least one of a compaction weight or a distal end of a boom of a compaction crane holding the compaction weight is positioned over the first drop location. An initial elevation of the compaction weight at rest at the first drop location may be determined from the rotational encoder. The compaction may be lifted lift, via a winch cable, to a drop height associated with the first drop location. The dynamic compaction controller may then detect, via at least one of the at least one boom deflection sensor or pressure sensor, when in time the compaction weight has been released. After release, the compaction weight may be re-hoisted, via the winch cable, to the drop height. A payout length of the winch cable when the compaction weight initially lifts off the ground may be measured by the rotational encoder. A current elevation of the compaction weight may be determined based at least in part on the payout length of the winch cable. Accordingly, the dynamic compaction controller may be able to determine whether the first target parameter is satisfied.

In one set of embodiments, the set of instructions may further include instructions executable by the at least one processor to identify, via the pressure sensor, when the compaction weight initially lifts off the ground based on a line pressure of the hydraulic line. The compaction system may also identify, via the at least one boom deflection sensor, when the compaction weight initially lifts off the ground based on the boom deflection of the distal end. Then, based at least in part on at least one of the line pressure or boom deflection, a trigger point to measure the payout length from which the current elevation of the compaction weight may be determined. In further embodiments, the set of instructions may further include instructions executable by the at least one processor to determine, via the at least one boom deflection sensor, the boom deflection, wherein the boom deflection indicates an amount of vertical displacement of the distal end of the boom. Thus, based on the at least one positional sensor, a distal end elevation at the trigger point may be determined. In another set of embodiments, the set of instructions may further include instructions executable by the at least one processor to determine a total drop count of compaction weight drops, wherein a compaction weight drop is only counted when a lift cycle has been completed for the compaction weight and the current elevation of the compaction weight is lower than the initial elevation.

In another aspect, a method for dynamic compaction is provided. In various embodiments, the method may include identifying, via a dynamic compaction controller, a first drop location of a plurality of drop locations, the first drop location associated with a first target parameter. It may then be determined, via at least one positional sensor, whether at least one of a compaction weight or a distal end of a boom of a compaction crane is positioned over the first drop location, wherein the distal end of the boom hoists the compaction weight via a winch cable. An initial elevation of the compaction weight at rest at the first drop location may be determined based on a rotational encoder. The compaction weight may be lifted, via a winch cable, to a drop height defined for the first drop location. It may then be detected, via at least one of the pressure sensor or an at least one boom deflection sensor, that the compaction weight has been released. The compaction weight may be re-hoisted, via the winch cable, to the drop height. A payout length of the winch cable when the compaction weight initially lifts off the ground may be measured via the rotational encoder. A current elevation of the compaction weight may then be determined based at least in part on the payout length of the winch cable. It may then be determined whether the first target parameter has been satisfied.

In one set of embodiments, the method may further include identifying, via the pressure sensor, when the compaction weight initially lifts off the ground based on a line pressure of a hydraulic line of a boom lifting system. In other embodiments, the method may identify, via the at least one boom deflection sensor, when the compaction weight initially lifts off the ground based on a boom deflection. Then, based at least in part on at least one of the line pressure and boom deflection, a trigger point to measure the payout length may be determined, from which the current elevation of the compaction weight is determined. In a further set of embodiments, the boom deflection may be determined, via the at least one boom deflection sensor, wherein the boom deflection indicates an amount of vertical displacement of the distal end of the boom, and a distal end elevation at the trigger point may be determined via the at least one positional sensor. In a further set of embodiments, the method includes determining, via the dynamic compaction controller, a total drop count of compaction weight drops, wherein a compaction weight drop is only counted when a lift cycle has been completed for the compaction weight and the current elevation of the compaction weight is lower than the initial elevation.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
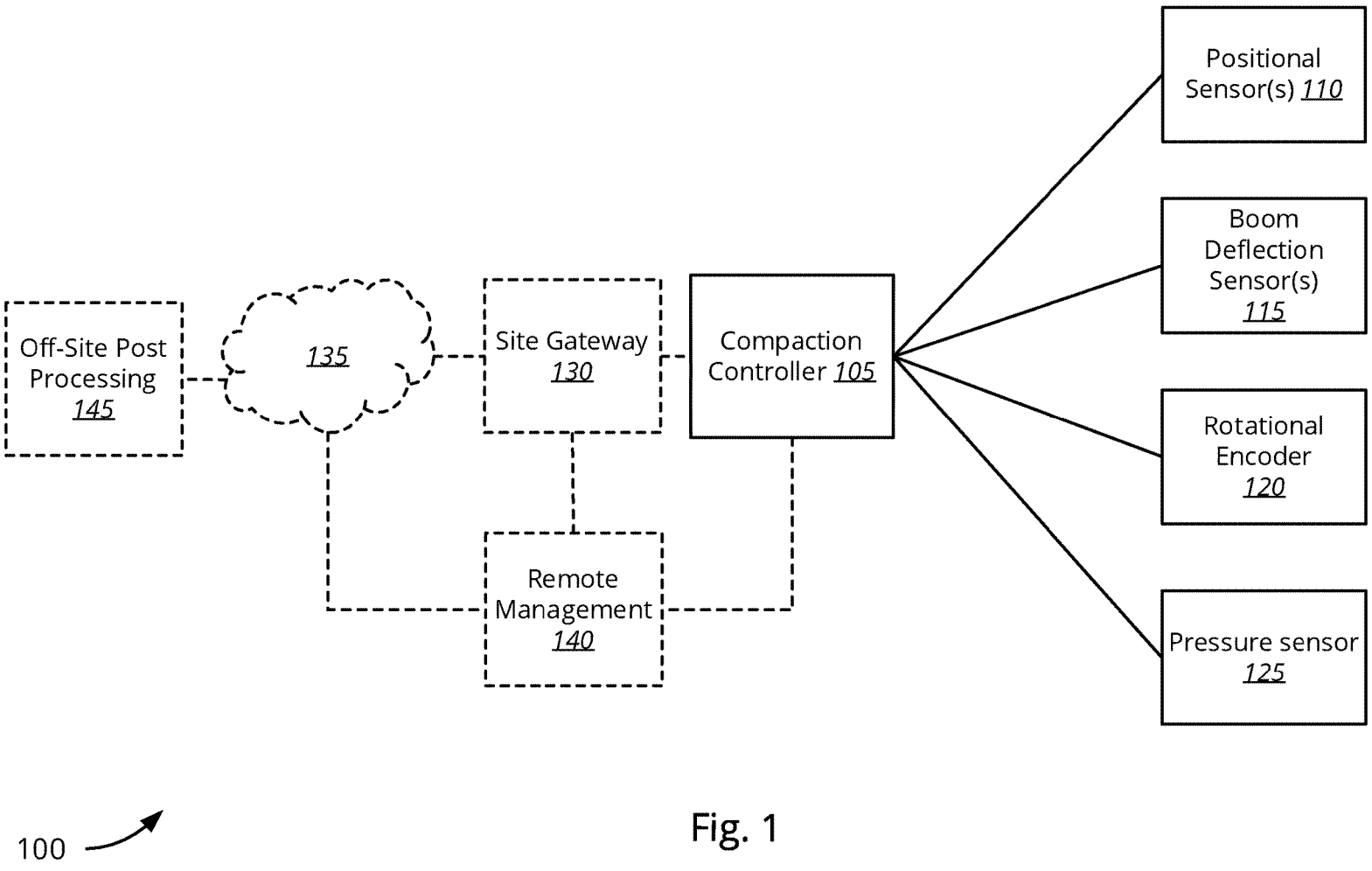
FIG. 1 is a schematic block diagram of a system for automated dynamic compaction, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The various embodiments set forth below provide a dynamic compaction system and method, where on-site and off-site are interconnected to communicate plans, instructions, measurements, and results. For example, in one set of embodiments, the manual operational grid layout can be eliminated in favor of remotely processing the operational grid prior to starting compaction machine operations. An operational grid may be created and readable by the compaction machine itself to navigate to, and self-align with drop locations, thereby eliminating manual layout errors and increasing accuracy of the drop location alignment and consistency of ground displacements at each drop location.

In some sets of embodiments, the compaction machine may further include an on-board navigation system to guide the compaction machine to the drop location. In embodiments where the compaction machine is a mobile crane with a boom, the navigation system may further be operable to position a distal end of the boom over the correct drop location. In some embodiments, positional accuracy better than 0.05 m may be achieved by the navigation system.

In further embodiments, ground displacement elevations may be computed from machine captured data to an accuracy required to meet project specifications, eliminating the requirement to manually measure drop-to-drop displacement and total ground displacement. Moreover, absolute elevations may be determined, as opposed to relative displacement from an initial surface elevation of a drop location or compaction weight, thus providing further consistency between each of the drop locations.

In this manner, in various embodiments, measurement data for each drop location may be captured and computed automatically for each drop at each drop location. The drop-to-drop displacement may be computed after each drop and may provide the operator with direct feedback as to progress. The number of drops may also be counted and captured automatically. Captured measurement data may be delivered to a central database through wired or wireless connections to a site gateway, providing oversight of the project from a remote location. In some further embodiments, the captured measurement data may be further be accessible by geotechnical analysis programs that can be used to assess the ground conditions beneath the compacted areas.

In further sets of embodiments, a type of compaction weight being used may be identified by various sensors of the compaction machine. For example, the mass of the compaction weight may be determined and compared to a design compaction weight for the area being compacted. In some further embodiments, a type of compaction weight may be suggested to the operator based on drop-to-drop displacement or total ground displacement, as compared to a target displacement for the drop location. In some embodiments, the operator or project manager may be notified that they are using the wrong type of compaction weight for the process, identifying and avoiding deliberate or inadvertent use of the wrong compaction weight type.

Furthermore, productivity increases and the reduction of process steps both in field and back office operations allow for drop locations to be completed at a faster rate. Manpower requirements, including on-site and off-site staffing requirements, and machine operating costs, such as fuel, maintenance, and service, may also be reduced.

FIG. 1 illustrates an automated dynamic compaction system 100, in accordance with various embodiments. The system 100 includes a compaction controller 105, at least one positional sensor 110, at least one boom deflection sensor 115, rotational encoder 120, and pressure sensor 125. The system 100 may further include an optional site gateway 130, communications network 135, remote management system 140, and off-site post processing 145.

According to various embodiments, the compaction controller 105 may be located on-site, attached to a compaction machine. In one set of embodiments, the compaction machine may be a mobile crane having a boom operatively coupled to a housing assembly. In various embodiments, the boom may be a telescoping boom that may be raised and lowered, and extended and retracted. The mobile crane may further include a boom lifting system for raising and lowering, and extending and retracting the boom. The lifting system may include, but is not limited to, a hydraulic pump and cylinder, electromechanical servomotor, and other alternative actuation solutions as known in the art. In some embodiments, the housing assembly may further be rotatable around a base of the mobile crane.

In various embodiments, the compaction controller 105 may include at least part of the operator controls of the compaction machine. The compaction controller 105 may be communicatively coupled to each of the at least one positional sensor 110, the at least one boom deflection sensor 115, rotational encoder 120, and pressure sensor 125. In various sets of embodiments, the compaction controller 105 may be a computer device, having one or more microprocessors, and programmed with software to manage dynamic compaction operation of the compaction machine. In further sets of embodiments, the compaction controller 105 may be an operator's end device, such as a tablet, laptop computer, or personal mobile device such as a smartphone. In yet further embodiments, the compaction controller 105 may be a dedicated hardware device, such as, without limitation, a system on a chip (SoC), application specific integrated circuit (ASIC), field programmable gate array (FPGA), or other similarly programmable embedded system programmed to manage dynamic compaction operation of the compaction machine.

According to various embodiments, the at least one positional sensor 110 may be operatively coupled to the compaction machine to determine a geographic position of the compaction machine. In embodiments, where the compaction machine is a mobile crane, the at least one positional sensor 110 may be able to determine a position of the distal end of the boom, housing assembly, or both. According to one set of embodiments, the at least one positional sensor 110 may include, without limitation, one or more global navigation satellite system (GNSS) receiver and one or more GNSS antennas. The one or more GNSS receivers and antennas may utilize various navigation systems including, without limitation, global positioning system (GPS), GLONASS, Galileo, and BeiDou systems.

In various embodiments where the compaction machine utilized a boom, the at least one boom deflection sensor 115 may detect a deflection of the distal end of the boom. In one set of embodiments, the deflection may be measured as a real-time elevation of the distal end of the boom. In other embodiments, the deflection may be determined by measuring strain experienced by the distal end of the boom. Accordingly, in one set of embodiments, the at least one boom deflection sensor 115 may, similar to the at least one positional sensor 110, utilize one or more GNSS receiver and one or more GNSS antennas operable on, without limitation, GPS, GLONASS, Galileo, or BeiDou. In other sets of embodiments, the at least one boom deflection sensor 115 may include a piezoelectric sensor, electrical strain gauge, fluid strain gauge, optical strain gauge, or other like devices.

According to various sets of embodiments, the rotational encoder 120 may be operatively coupled to a winch cable, winch wheel, or other suitable structure of the compaction machine to measure winch cable payout length or the length of winch cable that is rewound. For example, the rotational encoder 120 may include, without limitation, any of a friction drive depth sensor, optical encoder, magnetic encoder capacitive encoder, other mechanical encoder, or other suitable angle transducer device. In one set of embodiments, the rotational encoder 120 may be a friction drive depth sensor, which may be mounted, in frictional contact against the winch wheel at the distal end of the boom, thus providing an accurate measurement of the length of winch cable paid out and recoiled by the compaction machine. According to some embodiments, measurements made by the rotational encoder 120 may be combined with the measurements of the at least one positional sensor 110, and at least one boom deflection sensor 115, to determine a precise elevation of the compaction weight before the first drop, and the elevation after each drop of the weight at each drop location. The elevation information may then provide the drop-to-drop displacement, and total ground displacement values. In some embodiments, elevation measurements may be made from a top surface of the compaction weight, while in other embodiments, measurements may be made from the bottom surface of the compaction weight. In a further set of embodiments, elevation measurements of the drop location may be determined based on the measured elevation of the compaction weight.

In various embodiments, the pressure sensor 125 may be communicatively coupled to the boom lifting system of the compaction machine to measure and determine movement and slack on the winch cable as the compaction weight is lifted from the ground. In various embodiments, the compaction weight may be hitched to the winch cable via a crane hook, or other suitable method. Thus, after the compaction weight has been hitched to the winch cable, the operator may gradually rewind the winch cable, in a continuous or stepped manner, relying on measurements from the pressure sensor 125 to determine when the winch cable is taut and under the full load of the compaction weight. For example, in embodiments employing a hydraulic boom lifting system, the pressure sensor 125 may be coupled to a hydraulic line of the hydraulic cylinder. In other embodiments, in place of a pressure sensor 125, a feedback signal monitor may be utilized, for example, in embodiments using a servomotor based boom lifting system, to monitor feedback and line movement from the servomotor at a servo drive. In one set of embodiments, the pressure sensor 125 may be built into the hydraulic line of the boom lifting system of a mobile crane. In some embodiments, the pressure curve of the hydraulic line may be monitored at 100 Hz update rate to determine, while the winch cable is being recoiled, when the winch cable is slack, and when the winch cable is under load by the compaction weight. Thus, based on the pressure curve, the compaction controller 105 may determine when the compaction weight has been lifted from the ground, and when the compaction weight is released from the winch cable. In further sets of embodiments, measurements from the pressure sensor 125 may be used, in combination with the at least one boom deflection sensor 115, to determine a trigger point from which to measure the elevation of the compaction weight or of the drop location surface, via the rotational encoder 120, before the first drop, and after each subsequent drop. In further embodiments, the pressure sensor 125 may also be utilized to determine, based on the pressure curved, the number of drops completed at each drop location.

In various further sets of embodiments, the system 100 may include a sensor hub (not shown), communicatively coupled to each of the at least one positional sensor 110, at least one boom deflection sensor 115, rotational encoder 120, and pressure sensor 125. In a set of embodiments, the sensor hub may act as a communications hub to and from the compaction controller 105. In some embodiments, the sensor hub may further condition the power provided to each of the at least one positional sensor 110, at least one boom deflection sensor 115, rotational encoder 120, and pressure sensor 125, and provide over-voltage protection to the various components.

According to some sets of embodiments, the compaction controller 105 may optionally be communicatively coupled to a site gateway 130. The site gateway 130 may provide at least one of Wi-Fi, Bluetooth, cellular, radio frequency (RF), or other wireless communications capability, allowing the compaction controller 105 to communicate over communications network 135. In one set of embodiments, the compaction controller 105 may be able to receive, via the communications network 135, without limitation, data models, dynamic compaction plans, changes and updates to the dynamic compaction plan, remote operating instructions, and other off-site communications. Similarly, the compaction controller 105 may also be able to transmit measurements from each of the at least one positional sensor 110, at least one boom deflection sensor 115, rotational encoder 120, and pressure sensor 125, production measurements and as-built results for review by remote management 140. In one set of embodiments, the site gateway 130 may also allow, without limitation, remote access capability to facilitate remote support, fault diagnosis, operator training, and a real-time view of what the operator is seeing. In the above embodiments, communications network 135 may include, without limitation, a local area network ("LAN"), including without limitation a fiber network, or an Ethernet network;

a wide-area network ("WAN"); a wireless wide area network ("WWAN"); a virtual network, such as a virtual private network ("VPN"); the Internet; an intranet; an extranet; a public switched telephone network ("PSTN"); an infra-red network; a wireless network, including without limitation a network operating under any of the IEEE 802.11 suite of protocols, the Bluetooth protocol, or any other wireless protocol; or any combination of these or other networks.

Correspondingly, in various embodiments, remote management 140 may include both on-site and off-site remote management systems. For example, the remote management 140 system may be located on-site and directly communicate with the compaction controller 105, while in other embodiments, the remote management 140 system may communicate with the compaction controller via site gateway 130. In yet another set of embodiments, the remote management 140 system may communicate with the compaction controller 105 through communications network 135, via the site gateway 130.

According to various embodiments, the remote management 140 system may include all or part of off-site back-end modelling, and plan development. For example, in one set of embodiments, the remote management 140 system may include a business center application that provides the data modeling parameters to create surface models, compaction models, linework or point based information and associated plans for drilling, piling, soil stabilization, grade control, paving and compaction control operations. The remote management 140 system may further provide management of the data preparation process for the dynamic compaction operations. The data preparation process will start with the creation of appropriate data models and dynamic compaction plans that will be used by the compaction machine. The data models required for dynamic compaction operations will include, as a minimum, design creation and dynamic compaction plan creation.

According to various embodiments, designs can be used, in association with the dynamic compaction plan, by the machine operator to provide additional information that they require while working, and as entered by the operator from within the compaction machine. For example, additional parameters may be input, via the compaction controller, by the operator based on measurement information retrieved by the compaction controller. Designs may include linework, surface or corridor models, avoidance zones. Avoidance zones may include objects or areas that are underground, on the surface, or overhead, that need to be need to be avoided by the compaction machine, or indicate perimeter breaches of the project area.

In various embodiments, each project may include several dynamic compaction plans that may be delivered to a plurality of different compaction machines. In one set of embodiments, the dynamic compaction plan may define a work package to be completed by one or more of the plurality of compaction machines assigned to the work package. The dynamic compaction plan may contain, without limitation, an identifier for the dynamic compaction plan, estimated operation parameters, and an operational grid. For example, in one set of embodiments, estimated operation parameters may include, without limitation, compaction machine and operator costs per hour, and expected production metrics—such as an operational efficiency factor, expected time to move from drop location to drop location, expected time for each drop, and expected time to complete compaction for each drop location.

In some sets of embodiments, the dynamic compaction plan may further generate and operational grid for a bounded area, populating the bounded area with drop locations for compaction, based on defined boundaries for the bounded area. The dynamic compaction plan may further define operational grid parameters from which operational grids may be created, such as, without limitation, a fit of the operational grid to the bounded compaction area, as well as optimization of the grid to maximize production output. In a further set of embodiments, at least parts of the dynamic compaction plan, such as the operational grids, may be created from simplified source data, such as, without limitation, CAD or CSV point file data representing drop locations or grid pattern.

In another set of embodiments, the dynamic compaction plans may further establish and assign target parameters for each drop location of an operational grid. In some embodiments, each drop location may include a unique identifier used to track target and as-built measurements. Location information may be provided for each drop location, which may further indicate accuracy targets for the navigation system. Target parameters may further include a minimum required number of drops, maximum number of drops, and a target number of drops. Target parameters may further indicate a targeted drop-to-drop elevation change, or a target final elevation. Target parameters may also specify a size and weight of the compaction weight to be used, a target drop height, and target accuracy for each drop.

Similarly, in various embodiments, off-site post processing 145 system may include an automated dynamic compaction customer information system (ADCIS). The off-site post-processing 145 system may receive, manage, and make accessible, measurements from each of the at least one positional sensor 110, at least one boom deflection sensor 115, rotational encoder 120, and pressure sensor 125, production measurements and as-built results for review by remote management 140. Thus, in various embodiments, off-site post processing 145 may provide remote management 140 with near real-time tracking of production, progress, and quality at each of the drop locations, as well as for the project as a whole. Once compaction has been completed for a drop location, or for the entire project site, the compaction controller 115 may indicate to off-site post processing 145 that the drop location has been completed or that the project has been completed. The off-site post processing 145 may then generate a report for a given drop location, or for the entire dynamic compaction plan as a whole. In one set of embodiments, the report may include at least quality metrics, progress metrics, and production metrics. Quality metrics may indicate, for each of the completed dynamic compaction locations, whether compaction was completed within the expected tolerances for X-Y position, drop height requirements were met for each drop, that a total drop count met or exceeded a minimum required number of drops, drop-to-drop displacements, and total ground displacements. The dynamic compaction plan may define a total number of drop locations, and a total number of required drops at each of the drop locations. Thus, a progress metric may be defined based on the number of drops successfully completed, such as a current total drop count out of an expected target drop count if all required drops were completed at each of the drop locations. Production metrics may track variously production rates, and expected completion times, as defined and modeled in the dynamic compaction plan. Machine-captured information may define actual results, which may then be compared to the modeled and expected production rates and completion times. The off-site post processing 145 may then report deviations of the actual production rates and completion times from the modeled production rates and completion times, and the effect that the deviations may have on a projected completion of the dynamic compaction plan.

In a further set of embodiments, the system 100 may also include one or more tilt sensors additionally in communication with the compaction controller 105. In various embodiments, a tilt sensor may detect a boom angle, pitch and roll of a housing assembly or base of the compaction machine. Additionally, the tilt sensor may be able to detect an inclination angle of the crane relative to flat or even ground.

Figure 2:
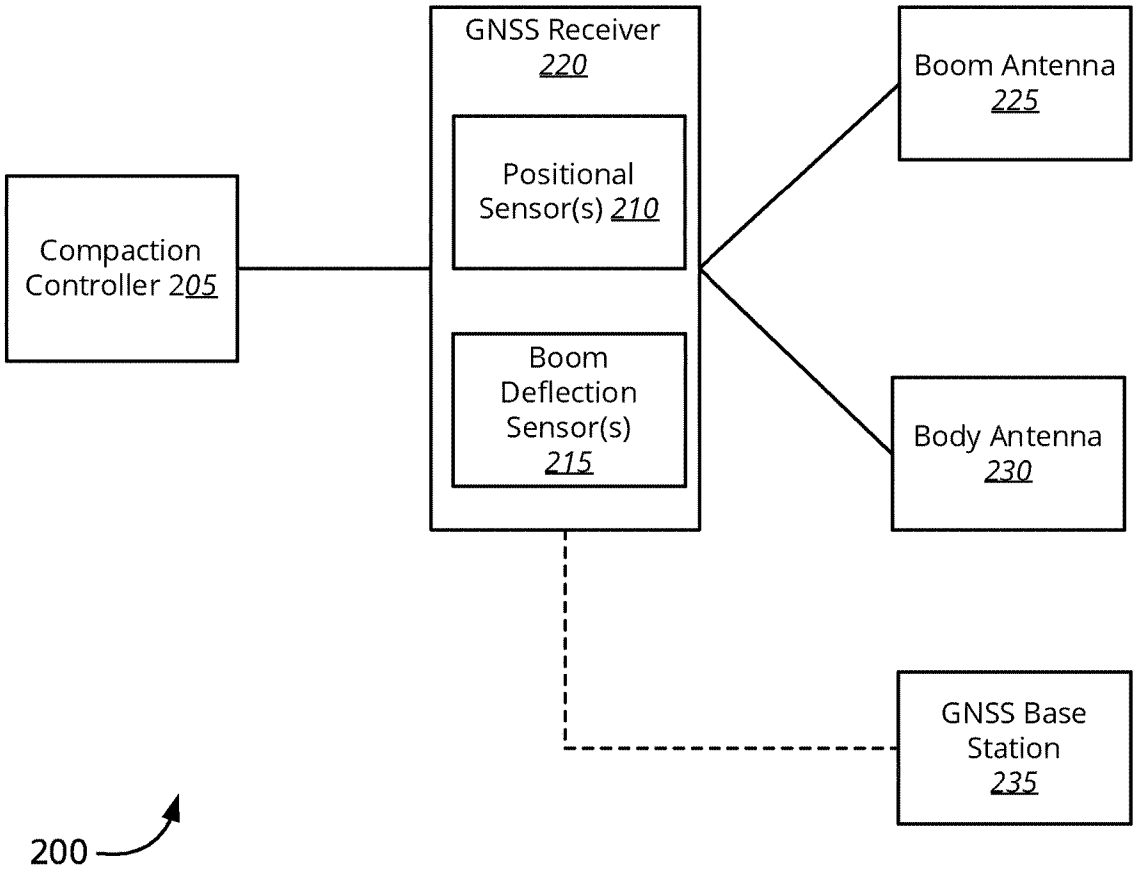
FIG. 2 is a schematic block diagram of an alternative arrangement for sensors in a system for automated dynamic compaction, in accordance with various embodiments.

FIG. 2 illustrates an alternative arrangement for the at least one positional sensor 210, and at least one boom deflection sensor 215 in a system 200 for automated dynamic compaction, in accordance with various embodiments. The system 200 includes a compaction controller 205, GNSS receiver 220 including at least one positional sensor 210 and at least one boom deflection sensor 215, a boom antenna 225, a body antenna 230, and GNSS base station 235.

According to one set of embodiments, a single GNSS receiver 220 may be include both the at least one positional sensor 210 and at least one boom deflection sensor 215. Thus, both of the at least one positional sensor 210 and at least one boom deflection sensor 215 may jointly utilize the boom antenna 225, body antenna 230, or both. The GNSS receiver 220 may be operably coupled to a base or housing assembly of the compaction machine. In various embodiments, the GNSS receiver 220 may be able to determine position, orientation, and elevation information for both the housing assembly and distal end of the boom. The GNSS receiver 220 may also be communicatively coupled to the GNSS base station 235. The GNSS receiver may further receive GNSS position corrections from the GNSS base station 235.

In one set of embodiments, the body antenna 230 may be operatively coupled to the housing assembly of the compaction machine, while the boom antenna 225 operatively coupled to the distal end of the boom. The boom antenna 225 and body antenna 230 may be in communication with one or both of the GNSS receiver 220 and GNSS base station 235, with the GNSS base station 235 having its own GNSS receiver. Thus, the GNSS receiver 220 in combination with the GNSS base station 235 may be able to provide navigation control for the operator, or automatically move and position the compaction machine over a drop location.

In one set of embodiments, the GNSS receiver 220 and GNSS base station 235 may be utilized in combination with a tilt sensor, as described above with respect to FIG. 1. Together, the GNSS receiver 220, GNSS base station 235, and tilt sensor may be able to determine and compare a drop location to the actual location of the distal end of the boom, in real-time. In some embodiments, location information, provided by the GNSS receiver 220 and GNSS base station 235, for the distal end of the boom, or housing assembly of the compaction machine, may include, without limitation, geographic coordinates indicating at least a longitudinal and latitudinal position, or relative position data as in a dead-reckoning process. In further embodiments, navigation controls may be provided to the operator instructing forwards, backwards, left, and right movements of the compaction machine, or rotation of the boom by rotation of the housing assembly, aligning the distal end of the boom with the drop location.

Figure 3:
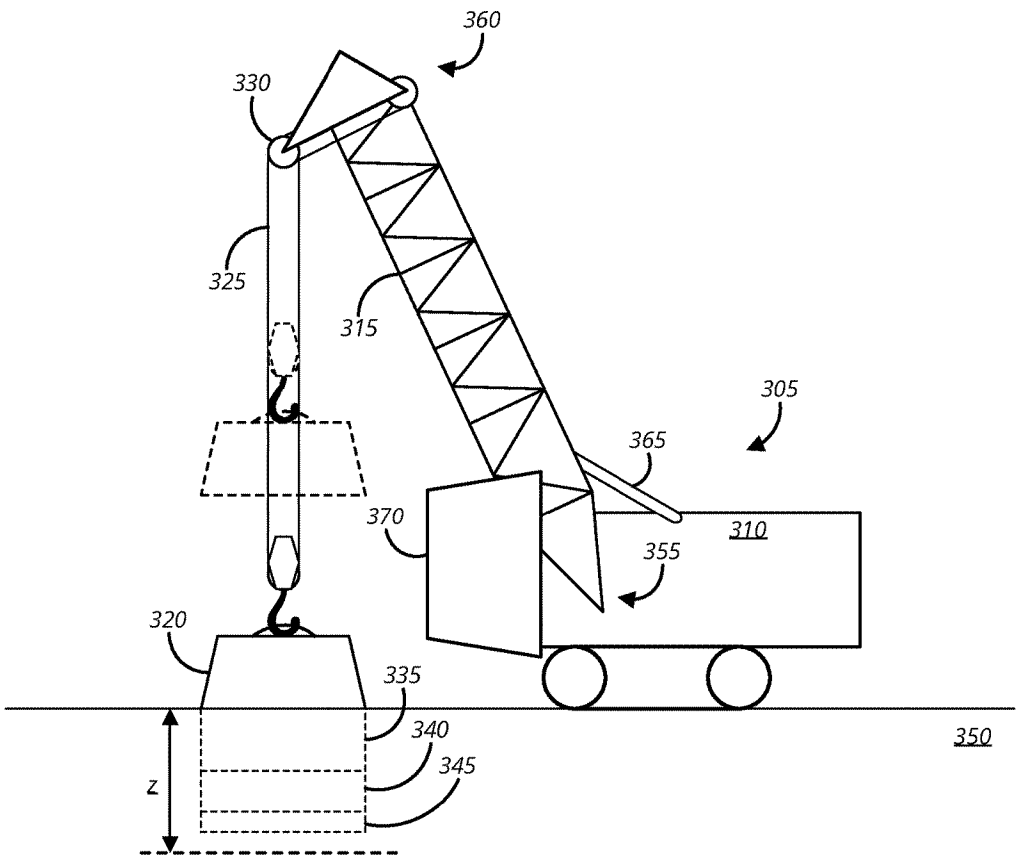
FIG. 3 is a schematic diagram of a compaction crane deployment, in accordance with various embodiments.

FIG. 3 illustrates a compaction crane deployment of an automated dynamic compaction system 300, in accordance with various embodiments. The system 300 includes a mobile compaction crane 305 having a housing assembly 310 and a boom 315, compaction weight 320, winch cable 325, winch wheel 330, a first drop ground displacement 335, second drop ground displacement 340, and third drop ground displacement 345, the compaction surface 350, a proximal end of the boom 355, distal end of the boom 360, boom lifting system 365, and operator cab 370.

According to various sets of embodiments, the compaction machine may be a mobile compaction crane 305 having a housing assembly 310, to which the boom 315 is operatively coupled. In some embodiments, the housing assembly 310 may be rotatable around a base of the mobile compaction crane 305, to rotate the boom 315 about the base of the mobile compaction crane 305 without having to move or relocate the mobile compaction crane itself. In various embodiments, the boom 315 may be a telescoping boom, capable of being raised and lowered, and extending and retracting. A boom lifting system 365 may further be operatively coupled to the boom 315 to raise and lower, and extend and retract the boom 315. As described above, with respect to FIG. 1, in various sets of embodiments, the lifting system 365 may include but is not limited to, a hydraulic pump and cylinder, electromechanical servomotor, and the like.

In various embodiments, the compaction weight 320 may be hitched to the winch cable 325 to be lifted, moved, and positioned by the boom 315. The compaction weight 320 may include, without limitation, a high-mass pounder or other suitable high-mass object, as known to those in the art, having a suitable for dynamic compaction applications. In some embodiments, a crane hook may utilized to hitch the compaction weight 320 to the winch cable 325. The winch cable 325, in turn, may be coupled to a winch wheel 330 at a distal end 360 of the boom 315. The compaction weight 320 may be lifted to a predetermined drop height, and upon reaching the predetermined drop height, the compaction weight 320 may be released by the crane hook and dropped onto the desired drop location. Upon impact with the ground 350, the compaction weight 320 may cause a first drop ground displacement 335, displacing the ground 350 beneath it at the desired drop location. This process may be repeated, creating the second drop ground displacement 340, third drop ground displacement 345, and so on, until a target parameter or combination of target parameters have been satisfied for the drop location. In various embodiments, as described with respect to FIG. 1, target parameters may include, without limitation, a final target elevation, a total ground displacement, a target drop-to-drop elevation change, a target drop-to-drop ground displacement, a target total drop count, a minimum required number of drops, maximum number of drops. In the depicted embodiments, a target final elevation is indicated as being a depth z from the starting elevation of the compaction weight 320. Once the target final elevation has been reached, the compaction crane 305 or boom 315 may be repositioned over a subsequent drop location for compaction, according to a dynamic compaction plan.

According to various sets of embodiments, with reference to FIGS. 1-3, a compaction controller 105, 205 may be located within the operator cab 370, or be a mobile device carried by an operator of the compaction crane 305. An at least one positional sensor 110, such as GNSS receiver 220 and GNSS antennas 225, 230, may be coupled to the boom 315, housing assembly 310, or within the operator cab 370. In various embodiments, a boom antenna 225 may be operatively coupled to the distal end 360 of the boom 315, and a body antenna 230, may be operatively coupled to the housing assembly 310, operator cab 370, or a base of the compaction crane 305. The GNSS receiver 220 may be coupled to the housing assembly 310, or may be positioned within the operator cab 370. Similarly, the at least one boom deflection sensor 115 may include a GNSS receiver 220, boom antenna 225 and body antenna 230. In embodiments where the at least one boom deflection sensor 115, 215 includes various types of strain gauges, the at least one boom deflection sensor 115, 215 may be operatively coupled to at least the distal end 360 of the boom 315, or cover all or part of the remainder of the boom 315. A rotational encoder 120 may further be operatively coupled to the winch wheel 330 or winch cable 325, at the distal end 360 of the boom 315. In embodiments where the rotational encoder 120 is a friction drive depth sensor, the friction drive depth sensor may be mounted such that a contact edge of the friction drive wheel makes frictional contact with one face of the winch wheel 330 along a peripheral edge of the face. It will be appreciated by those skilled in that art, that in other embodiments, other arrangements may be utilized, and the above embodiments should not be construed as limiting. For example, in other sets of embodiments, the friction drive depth sensor may include a grooved contact wheel through which the winch cable 325 may itself be passed through. In other embodiments, edge to edge contact may be made between the friction drive depth sensor and winch wheel 330. In further embodiments, other types of rotational encoders may be utilized, allowing even more alternative arrangements to be utilized. In various embodiments, the pressure sensor 125 may be in fluid communication with the boom lifting system 365. In embodiments where a hydraulic cylinder is utilized, the pressure sensors may operatively couple to a hydraulic line feeding the hydraulic cylinder, thus monitoring hydraulic pressure to the hydraulic cylinder. In embodiments where the boom lifting system 365 is servomotor driven, rather than monitor pressure, the pressure sensor 125 may instead monitor a servo drive signal and signal feedback induced by movement of the boom 315.

In yet a further set of embodiments, GNSS receiver 220, GNSS boom antenna 225, and GNSS body antenna 230 may be utilized in combination with a GNSS base station 235 to determine a position orientation, and elevation information for both the housing assembly 310, and distal end 360 of the boom 315. The GNSS receiver 220 may further be communicatively coupled to the compaction controller 105, 205. Thus, in some embodiments, the compaction controller 105, 205 may be able to provide navigation directions to an operator in the operator cab 370. In some further embodiments, the compaction controller 105, 205, and GNSS receiver 220 may be able to automatically navigate and drive the mobile compaction crane 305 into position, and further position the distal end 360 of the boom 315 in alignment with a desired drop location. According to one set of embodiments, the mobile compaction crane 305, boom 315, and distal end 360 of the boom 315, may be moved into position to match the geographic coordinates associated with the desired drop location, as indicated in a dynamic compaction plan.

Key capabilities provided by the automated dynamic compactions systems 100, 200, 300, over conventional dynamic compaction approaches, can include (without limitation) the ability and methodology to determine elevations and elevation changes with accuracy and/or precision that fall within specified dynamic compaction tolerance requirements. While measurements of compaction depth or elevation, ground displacement, drop-to-drop elevation, and drop-to-drop displacement may be completed manually, conventional manual measurements are inherently inaccurate and inconsistent, prone to human error and variation between measuring individuals. Accordingly, the automated dynamic compaction system provides an altogether new approach, implementing sensor fusion techniques to accurately determine elevations and ground displacements from a sensor fusion analysis of machine measured line pressure, boom deflections, position information, and winch cable payout lengths, that would not be possibly under the conventional approach.

For example, when the compaction weight 320 is at rest on the ground 350, measurement of the elevation of the compaction weight 320 must be taken when the winch cable 325 is taut under the load of the compaction weight 320. Thus, a the compaction controller 105, 205, based on detected boom deflection and line pressure at the boom lift system 365, may determine a trigger point at which the elevation length measurements should be taken. The trigger point may be determined, in near real-time, as the compaction weight 320 is being lifted. Additional capabilities include, without limitation, determination of winch cable 325 stretch by the compaction weight 320, consistent determination of a target drop height, determining whether to count a drop as part of the total drop count, determining the rate of winch cable 325 payout, and providing an operator interface through which to operate the compaction crane 305 providing the operator with a visualization of the location of the boom 315 and compaction weight 320 location, precise navigation information and guidance tools, indicators for drop count, target drop counts, a boom 315 inclination angle, elevation measurements for a drop location, and other target parameters that may be available in the dynamic compaction plan for a specific drop location.

According to various sets of embodiments, the dynamic compaction system 100, 200, 300 may be initialized as follows, by first measuring the compaction crane 305, and compaction weight 320 to determine their geometrical shape and size. In some embodiments, the positions of the boom antenna 225 and body antenna 230 are measured to determine the position of the GNSS Antennas 225, 230 in relation to the housing assembly 310, boom 315, and distal end 360 of the boom 315. In some further embodiments, a "tool position" may be determined. The tool position may indicate a point on the compaction crane 305, for example a distal end 360 of the boom 315, from which the geographic position the compaction weight 320 is determined. Thus, the tool position may be used to position the compaction weight 320 in the correct location for each drop location. For example, in one set of embodiments, the tool position may be determined to be centered between rest positions of the winch cable 325 when viewed from a top elevation view, when the compaction weight 320 is suspended from the winch cable 325.

According to various embodiments, the rotational encoder 120 may be calibrated by lifting the compaction weight 320 through a defined distance that is marked and measured on any of the winch cable 325, or winch wheel 330. Once the marked position has been reached, a ratio may be calculated between the distance measured by the rotational encoder 120 and the actual the actual measured distance. This ratio may be used to adjust subsequent measurements of the compaction weight 320 elevation.

In various embodiments, the pressure sensor 125 may also be calibrated to identify "critical points" in a lift sequence, in order to generate a pressure curve that can be used to determine the trigger points for the compaction weight 320 elevation measurement at both lift off, when the compaction weight 320 leaves the ground during each lift sequence, and release, when the compaction weight 320 is released from the winch cable 325 at the top of the lift cycle during each lift sequence. These measurements enable the computation of the actual elevation of the compaction weight 320 at its rest position before the first and after each drop sequence. This in turn may be used to determine drop-to-drop displacement for each drop, the total ground displacement, and the drop distance, the distance that the compaction weight 320 falls for each drop at each drop location.

In some further embodiments, the boom deflection of a distal end 360 of the boom 315 may be calibrated to determine the distance from a resting position that the distal end 360 of the boom 315 displaces during a lift cycle. Identifying and calibrating relative to a resting position of the distal end 360 may be used to further determine the trigger point. In one set of embodiments, the boom deflection may be measured as a vertical displacement of the boom antenna 225 as the compaction weight 320 is being lifted by the compaction crane 305.

In another set of embodiments, compaction weight calibration may be performed for each type of compaction weight 320 to be used. Compaction weight 320 types may include weights of different masses, such as, without limitation, 1000 kN, 2000 kN, and 3000 kN compaction weights 320. The compaction weight calibrations may be used to identify the type of compaction weight 320 in use, and the type of compaction weight 320 to use at each drop location. Identification of the compaction weight 320 may further ensure that the correct type of compaction weight 320 is being utilized, according to a dynamic drill plan for the drop location.

According to a set of embodiments, after the pressure sensor 125 has been calibrated, the pressure sensor 125 may be utilized to measure and monitor a hydraulic line pressure, servo drive signal, or other similar signal of the boom lifting system 365. In embodiments utilizing a hydraulic cylinder and hydraulic line, a pressure curve may be generated by the pressure sensor 125 of a detected hydraulic line pressure during a compaction weight 320 lift sequence. In one set of embodiments, the pressure curve may show a rising hydraulic line pressure from an initial unloaded rest value of around 3 Bar, to a loaded peak value of around 190 Bar at which point the compaction weight 320 is fully loaded onto the winch cable 325. The pressure level may be sustained at a value of 190 Bar through the remainder of the lift process until the compaction weight 320 is released. Once released, the pressure levels rapidly fall and return to unloaded rest values. At the start of the lift process, pressure levels may increase rapidly, over a period of up to 3 seconds, until the loaded peak value is reached once the compaction weight 320 has been fully lifted off the ground. The pressure ramp-up period corresponds to measured pressure levels as the winch wheel tensions 330 the winch cable 325, and the distal end 360 of the boom 315 deflects to facilitate lifting the compaction weight 320 off of the ground 350.

According to a further set of embodiments, a trigger point may be determined to begin the elevation measurement process at the rotational encoder 120. In one set of embodiments, the point at which the distal end 360 of the boom 315 starts to deflect may be used to determine an optimal point in the lift cycle to trigger elevation measurement of the compaction weight 320 on the ground. A trigger point may be chosen at which the winch cable 325 may be taut, but not fully tensioned or stretched. In some embodiments, the pressure signal alone may be sufficient to determine the trigger point. In other embodiments, the pressure signal alone may be insufficient to measure the start of the lift cycle, and a boom deflection curve may be utilized in combination with pressure curve to determine an appropriate trigger point. At the release end of the lift cycle, the pressure curve automatically falls almost immediately when the compaction weight 320 is released, and provides a very clear indication of the point at which the compaction weight 320 has been released, at which time the rotational encoder 120, and at least one boom deflection sensor 115, 215 or GNSS boom antenna 225 position may be measured.

In various embodiments, the at least one boom deflection sensor 115, 215 may measure boom deflection over multiple lift cycles to determine the elevation of the compaction weight 320, and to generate a deflection curve showing a displacement of the distal end 360 of the boom 315 from an initial, unloaded resting position. As the boom 315 becomes loaded with the compaction weight 320, via tensioning of the winch cable 325 as the compaction weight 320 is lifted, and to the release point of the compaction weight 320. Thus, in one set of embodiments, the deflection curve may follow a repetitive cycle of expected behavior at the distal end 360 of the boom 315. The deflection curve may further exhibit two distinct plateaus. A lower plateau may indicate a position of the distal end 360 of the boom 315 under full load of the compaction weight 320. The higher plateau may correspond to the unloaded resting position of the boom 315, while the compaction weight 320 is on the ground, or after the compaction weight 320 has been released. In some further embodiments, a spike prior to the higher plateau may be caused when the compaction weight 320 is initially released at the top of the lift cycle. The release of the compaction weight 320 may cause a springing effect at the distal end 360 of the boom 315, such that the distal end 360 deflects upwards, past a resting position, and back downwards, below the resting position, oscillating in this manner until the resting position is reached.

In various embodiments, the rotational encoder 120 may be used to determine elevations from a trigger point that is determined as described above. In embodiments utilizing a depth sensor, a measured depth may be inverted to give an elevation of the compaction weight 320.

According to a set of embodiments, the elevation of the distal end 360 of the boom 315, as measured by the rotational encoder 120, at the top of the lift cycle when the compaction weight 320 is hoisted to the desired drop height, may "drift" from drop to drop. In some embodiments, the peak elevation of the distal end 360 of the boom 315 at the top of each lift may be measured as getting progressively lower. In one set of embodiments, the compaction crane 305 may experience movement between drops, a change in the inclination angle of the boom 315, or "sinking" of the compaction crane 305 over time. In these cases, elevation correction may be applied based on measurements from the GNSS receiver 220 of the elevations of the boom antenna 225 and body antenna 230, or further in combination with one or more tilt sensors. However, in other embodiments, the drift may not be attributable to movement of the compaction crane 305, changes in boom inclination angle, or sinking. For example, in various embodiments, the drift may be caused by drift in the rotational encoder 120; slippage of winch cable 325 from the winch wheel 330 or slippage of the rotational encoder 120 from the winch wheel 330; or stretching of the winch cable 325 when tensioned under load.

In embodiments where slippage is occurring between the winch cable 325 and winch wheel 330, or the rotational encoder 120 and the winch wheel 330, the slippage may be identified as "jumps" or "steps" in the measured payout length of the rotational encoder 120 over time. In embodiments where the winch cable 325 stretches under load, the stretch may be measured by the rotational encoder 120 as extra winch cable 325. When the compaction weight 320 is released, the winch cable 325 returns to its unstretched state. Thus, when the winch cable 325 is lowered for re-hoisting of the compaction weight 320, the rotational encoder 120 may not measure the lost stretch on the payout of the winch cable 325. This causes a depth/elevation change that reveals itself as drift in the continually lowering peak elevation value from lift cycle to lift cycle.

According to a set of embodiments, to correct for the drift due to slippage and stretching, it is assumed that the distal end elevation at the top of the lift cycle—as given by the boom antenna 225—is at a fixed offset from the measured elevation, as given by the rotational encoder 120, from drop to drop. Thus the measured depth/elevation from the rotational encoder 120 may be corrected for any deviations from an initially recorded offset to the reported distal end elevation.

Additional sources of error have been identified in various embodiments and arrangements of the system, including, without limitation, inconsistency of drop height offset from the elevation of the boom antenna 225 at the distal end 360 of the boom 315, winch cable 325 stretching early in the lift cycle, data correlation errors in measurements from the GNSS receiver 220, tilt sensor, rotational encoder 120, pressure sensor 125, the at least one positional sensor 110, and at least one boom deflection sensor 115, GNSS elevation errors, machine body tilt, errors in the trigger point determination, twisted cables, tilted weights, and hole cave-in. In various embodiments, the compaction controller 105, 205 may correct for these errors.

For example, in some embodiments, data correlation errors introduced by variations in the polling rates rotational encoder 120, pressure sensor 125, and GNSS receiver 220 may be corrected for by utilizing various interpolation schemes. For example, in one set of embodiments, the GNSS receiver 220 and rotational encoder 120 may be monitored at 7 Hz, while the pressure sensor may take measurements at 100 Hz. Accordingly, a linear interpolation may be appropriate in this context. GNSS elevation errors may be addressed by looking at variations in the reported elevations. In one set of embodiments, real time kinematic (RTK) GNSS in a static environment (not moving or vibrating) may provide an accuracy specification of +/−0.008 m in position and +/−0.015 m in elevation. When the GNSS receiver 220 and boom antenna 225 are placed on the compaction crane 305, the accuracy may be reduced. This may be seen as noise in the GNSS curves presented. In one set of embodiments, after release of the weight on some of the drops, the GNSS elevation values may shift by ~0.1 m for both plateaus in the boom elevation (loaded and unloaded elevations). This appears as if the GNSS failed to "fix" correctly. Because the boom antenna 225 may be affected more than the body antenna 230, during the high frequency oscillations after weight release, variations may be isolated by measurement of the horizontal and vertical baselines between the two antennas, and waiting for GNSS stability before starting a subsequent lift cycle. In another set of embodiments, machine body tilt may be tracked by tilt sensors or the body antenna 230. The elevation of the body antenna 230 may be monitored during repeated lift cycles to determine elevation changes as the compaction weight 320 is loaded onto the boom 315. In one set of embodiments, the body antenna 230 may move upwards by an average of 0.019 m during each lift cycle, and as expected are in the opposite direction to the movement of the boom antenna 225. The 0.019 m upward movement of the housing assembly 310 under load may also be included in the downward deflection of the crane boom under load, and may be accounted for in the lift and release process. However, when at rest at the start of each new drop location, the computation of the ground elevation beneath the tracks of the machine uses relies on the elevation of the body antenna 230, adjusted by the measured offset to the base of the tracks or wheels mounted to the housing assembly 310. Accordingly, elevation variations of the body antenna, relative to the ground, introduced by machine tilt, may be estimated at 0.024 m based on the geometry of the machine, and assuming a uniform tilt of the machine around the rotation center of the machine, may also be corrected for.

In additional embodiments, it may be possible for the winch cable 325 twists by rotation of the compaction weight 320 between drops. In various embodiments, this may result in an error in elevation measurements system for the drop with the twisted cable and the subsequent drop at which point the elevation error is corrected. In a further set of embodiments, it may be possible for the compaction weight 320 to either make contact with a lip of uncompacted soil defining a hole created by the compaction process. Thus, as the compaction weight 320 drops and makes contact with the lip, the compaction weight may become tilted as it enters the compaction hole. Alternatively, the sides of the compaction hole may cave-in during the lifting and dropping processes. Accordingly, as the compaction weight 320 makes impact with the ground, the compaction weight 320 may tilt, significantly departing from a desired horizontal position after each lift and drop sequence. In some embodiments, when the compaction weight 320 becomes tilted, the compaction controller 105, 205 may exclude the drop from a total drop count, drop to drop elevation change, and average drop displacement determinations.

In one set of embodiments, the compaction controller 105, 205 may further keep a total drop count of completed drops for each drop location. To determine a completed drop, a lift cycle may only be counted if the elevation of the compaction weight 320 at the trigger point is lower than the elevation at the trigger point for the prior drop. Because operators may sometimes lift and lower the compaction weight 320 to the ground to stop swinging of the compaction weight 320, a partial invalid lift may be created. In some embodiments, to account for partial lifts such these, the compaction controller 105 may determine whether the compaction weight was first raised to a drop height exceeding a threshold value above the starting elevation of the compaction weight 320, prior to the first lift, in order for the drop to be counted a completed drop.

According to one set of embodiments, a compaction weight elevation may be determined to identify a drop-to-drop displacement value to better than 0.05 m accuracy, where the value is computed as the average of the last two drops at the drop location. In various embodiments, to determine drop displacement values, or alternatively, compaction weight elevations, required measurements may include, without limitation: a payout length of winch cable 325, as determined by rotational encoder 120; determination of a trigger point, as described with respect to the embodiments above, the elevation of a distal end 360 of the boom 315; the amount of boom deflection under full load; and an elevation of the distal end 360 at a release point when the compaction weight 320 was released. In various embodiments, the payout length of winch cable 325 should increase after each drop, reflecting the drop displacement of the ground 350. Because the payout length is measured relative to an elevation of the distal end 360, the elevation of the distal end at the trigger point is required. In some embodiments, the boom antenna 225 may provide this elevation, in real-time, to an accuracy of ~0.015 m.

Figure 4A:
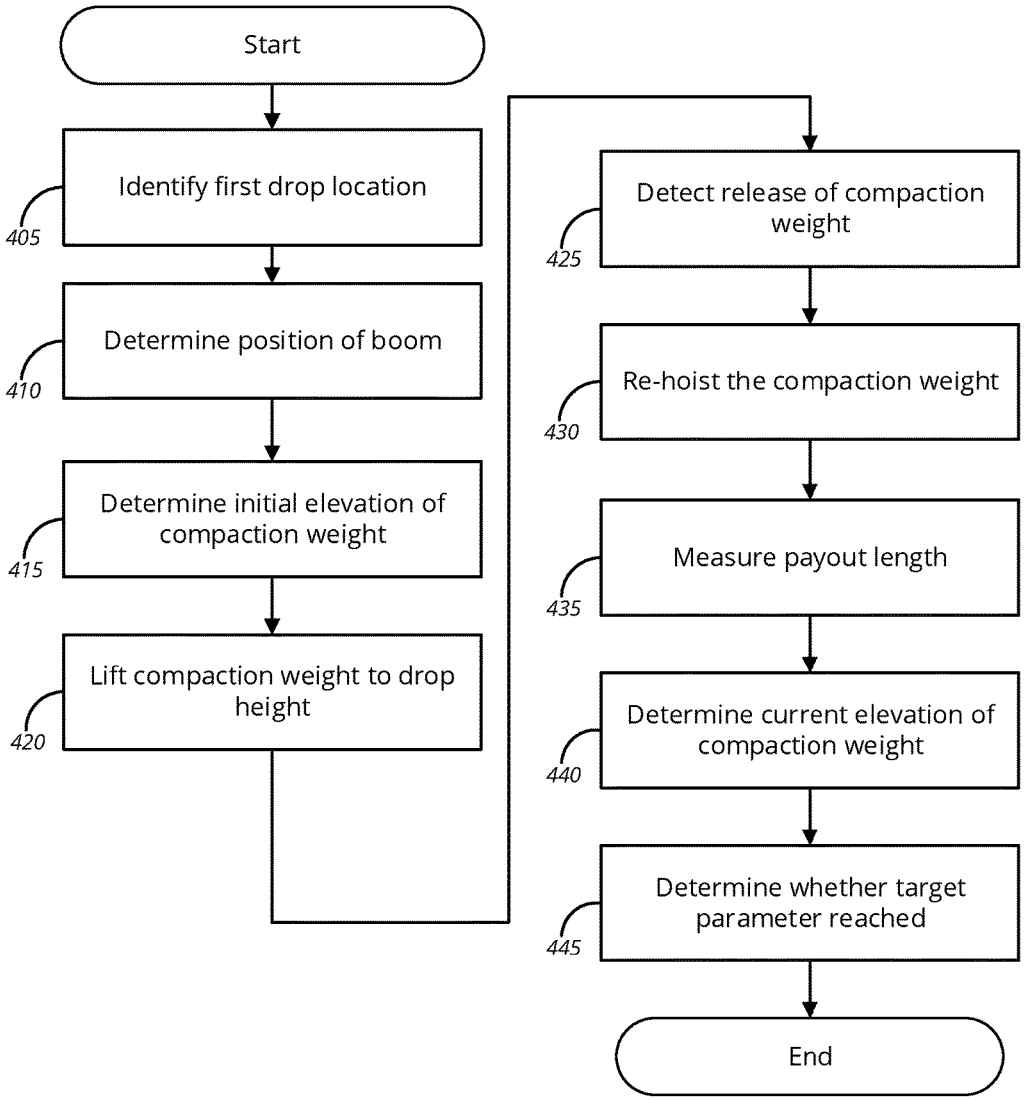
FIG. 4A is a flow diagram of a method for a system for automated dynamic compaction, in accordance with various embodiments.

FIG. 4A illustrates a flow diagram of a method 400A for an automated dynamic compaction system, in accordance with various embodiments. The method 400 begins at block 405, by identifying a first drop location. In various embodiments, a compaction controller of a compaction machine may receive a dynamic compaction plan having an operational grid indicating a plurality of drop locations. Each of the plurality of drop locations may be associated with one or more target parameters. The compaction controller may further determine, from the plurality of drop locations, a first drop location at which to begin compaction operations.

At block 410, a position of the boom is determined. According to one set of embodiments, the compaction controller may determine, via an at least one positional sensor, a geographic position of a distal end of the boom. In various embodiments, the compaction controller may further provide navigation instructions to move the compaction machine forward, backward, left, right; or to rotate, extend, retract, raise, lower the boom.

At block 415, an initial elevation of the compaction weight is determined. It is to be understood that the initial elevation refers to an initial resting elevation of the compaction weight before being raised to a drop height for a drop, and is not limited to a pre-compaction elevation. For example, in some embodiments, the initial elevation may refer to the elevation of the compaction weight after a first drop. In other embodiments, it may be after a second drop, third drop, and so forth. According to one set of embodiments, as will be described with respect to measurement of a current elevation, the initial elevation may be determined based on a separate trigger point determined for the current lift cycle.

At block 420, the compaction weight is lifted to the drop height. In one set of embodiments, the drop height may be defined for the first drop location, as indicated in the dynamic compaction plan. In some embodiments, during this lift cycle, a hydraulic line pressure curve and boom deflection curve may be used to determine a trigger point from which to measure the initial compaction weight elevation.

At block 425, release of the compaction weight is detected. In one set of embodiments, the release of the compaction weight may be detected based on a detected line pressure curve. In other embodiments, a boom deflection curve may be utilized, in combination with the line pressure curve, to determine a release point of the compaction weight.

At block 430, the compaction is re-hoisted to the drop height. In various embodiments, the compaction weight may be hitched to the winch cable via a crane hook or other suitable hitch device. As the compaction weight is re-hoisted, the winch cable may again undergo tautening, and at the same time stretching, under load of the compaction weight as the compaction weight is being lifted.

At block 435, a payout length of the winch cable may be measured. According to one set of embodiments, the payout length may be measured at a point when the compaction weight initially lifts off the ground. Thus, in one set of embodiments, a rotational encoder may measure or determine a payout length at the point of liftoff. In various embodiments, the point of liftoff may be determined as the trigger point from which to measure the payout length, and correspondingly, the elevation of the compaction weight. As discussed above, the trigger point may be determined as a function of a detected line pressure curve and boom deflection curve, as reported by a pressure sensor and at least one boom deflection sensor, respectively.

At block 440, a current elevation of the compaction weight is determined. In various embodiments, the current elevation of the compaction weight may be determined based at least in part on the payout length. In some embodiments, the current elevation may further rely on a boom deflection and distal end elevation to more accurately determine the compaction weight elevation.

At block 445, the compaction controller may then determine whether a target parameter for the first drop location has been satisfied. In various embodiments, the target parameters may include, without limitation, a minimum drop count, maximum drop count, total drop count, drop-to-drop elevation change, target elevation, or total elevation change, or combination of the above target parameters. In further embodiments, alternative target parameters may include a minimum drop-to-drop ground displacement, or total ground displacement.

Figure 4B:
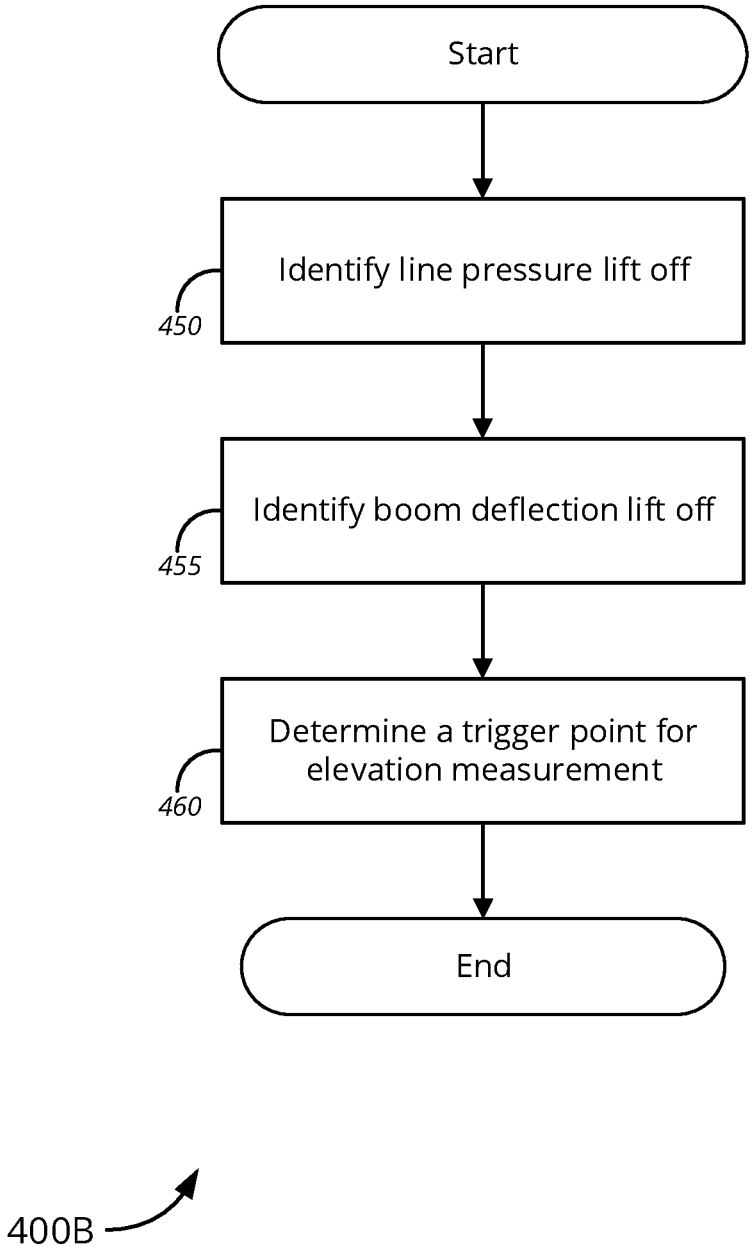
FIG. 4B is a flow diagram of a method for identifying a trigger point, in accordance with various embodiments.

FIG. 4B is a flow diagram of a method 400B for identifying a trigger point, in accordance with various embodiments. The method 400B begins, at block 450, by identifying when the compaction weight has been lifted off the ground based on a detected line pressure. Because the elevation of the compaction weight should be measured when no slack is present on the line, in various embodiments, the compaction controller may generate a line pressure curve to be analyzed to determine when the compaction weight has been lifted from the ground, thus eliminating line slack.

At block 455, the compaction controller determines when the weight has been lifted off the ground based on a detected boom deflection. The compaction controller may similarly generate a boom deflection curve to determine when the distal end fully displaces under the load of the compaction weight.

At block 460, a trigger point is determined based on the detected line pressure and boom deflection. According to a set of embodiments, the trigger point may determine the time from which the rotational encoder may measure or determine a winch cable payout. In some embodiments, the trigger point may be determined on-the-fly, in near real-time as the compaction weight is being lifted from the ground. Thus, the rotational encoder may measure or detect the payout length and/or compaction weight elevation dynamically in response to the determined trigger point. In some further sets of embodiments, either of the boom deflection or line pressure may alone be sufficient to determine a trigger point, while in other embodiments a combination of both boom deflection and line pressure are utilized to more accurately determine a trigger point.

Figure 4C:
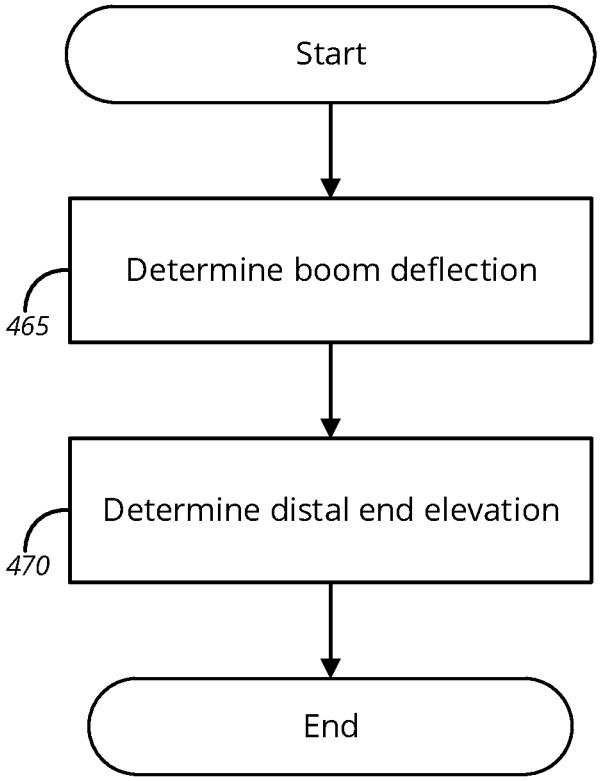
FIG. 4C is a flow diagram of a method for determining boom deflection and distal end elevation, in accordance with various embodiments.

FIG. 4C illustrates method 400C for determining boom deflection and distal end elevation, in accordance with various embodiments. The method 400C begins at block 465, where the boom deflection is determined as a vertical displacement of a distal end of the boom. According to various embodiments, the vertical displacement may be determined based on relative measurements of the boom deflection sensor, such as changes in distal end elevation from a resting, unloaded position. In further embodiments, a maximum boom deflection displacement may further be determined. At block 470, a distal end elevation may be determined at the trigger point. Thus, based on the boom deflection and detected distal end elevation, the current elevation of the compaction weight may more accurately be determined.

Figure 4D:
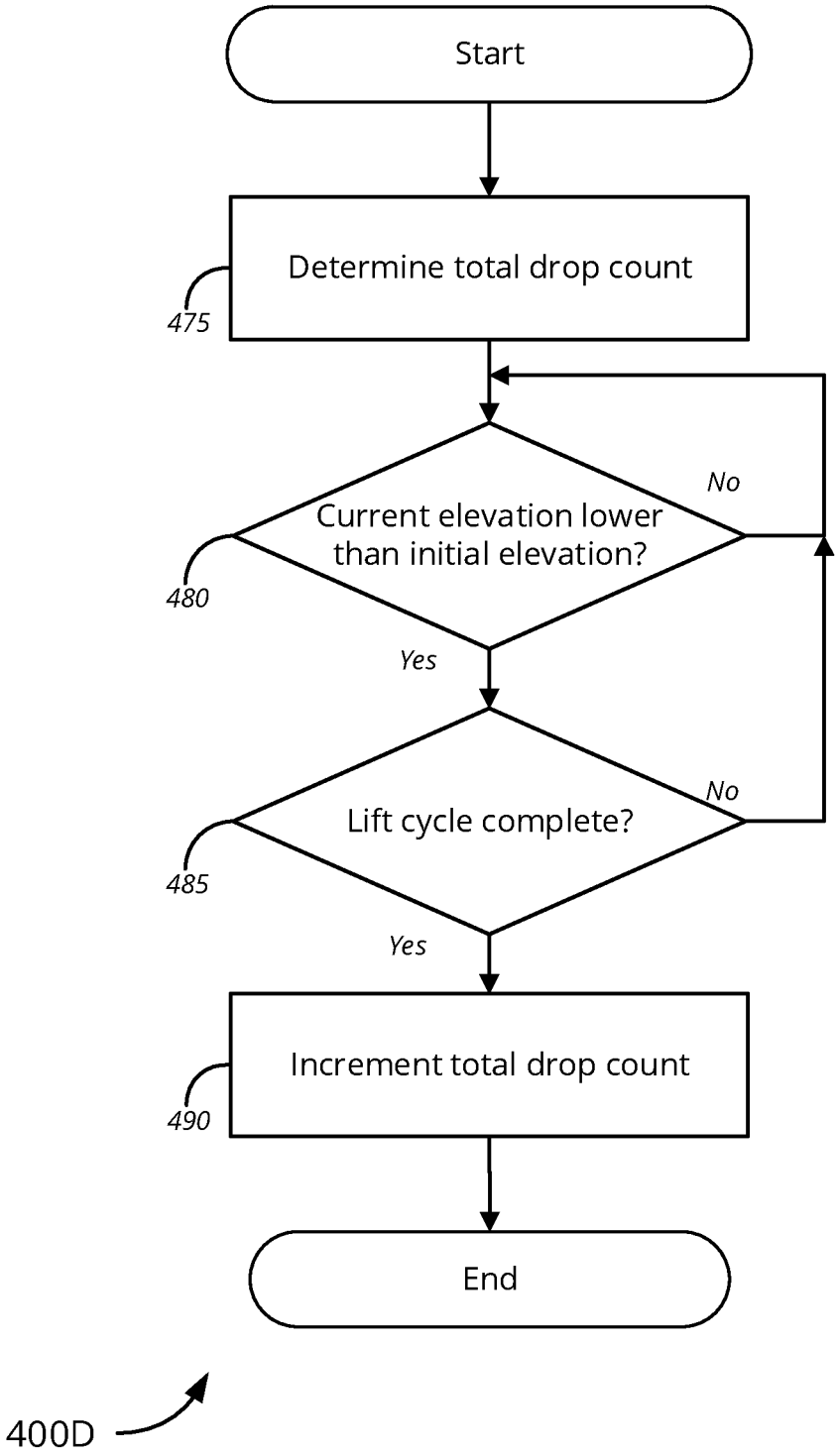
FIG. 4D is a flow diagram of a method for determining a total drop count, in accordance with various embodiments.

FIG. 4D is a method 400D for determining a total drop count, in accordance with various embodiments. The method 400D begins, at block 475, by determining a total drop count at the first drop location. According to various sets of embodiments, the dynamic compaction controller may only count drops that have been completed, and only if the measured current elevation of the compaction weight is lower than the previous initial elevation. Therefore, at decision block 480, the compaction controller may determine whether the current elevation is indeed lower than the initial elevation. If the current elevation is not lower than the initial elevation, in one set of embodiments, the total drop count may not be incremented, and the compaction controller may wait for a measured current elevation to be lower than an initial elevation. If, however, the current elevation is measured to be lower than the initial elevation prior to the drop, the compaction controller may further determine, at block 485, whether the lift cycle has been completed. A lift cycle may be considered completed based on various criteria. In one set of embodiments, the lift cycle may be considered completed if, for example, the compaction weight was lifted to a drop height exceeding a threshold value above a pre-compaction elevation, the initial elevation, or other previous compaction weight elevation. In another set of embodiments, the lift cycle may only be considered complete if a threshold drop-to-drop elevation change between two sequential drops, or drop-to-drop displacement of the first drop location is exceeded. If the lift cycle is determined not to have been completed, the method returns, to decision lock 480, to receive a measured current elevation below that of an initial elevation. If the lift cycle is determined to have been completed, then, at block 490, the total drop count is incremented.

Figure 5:
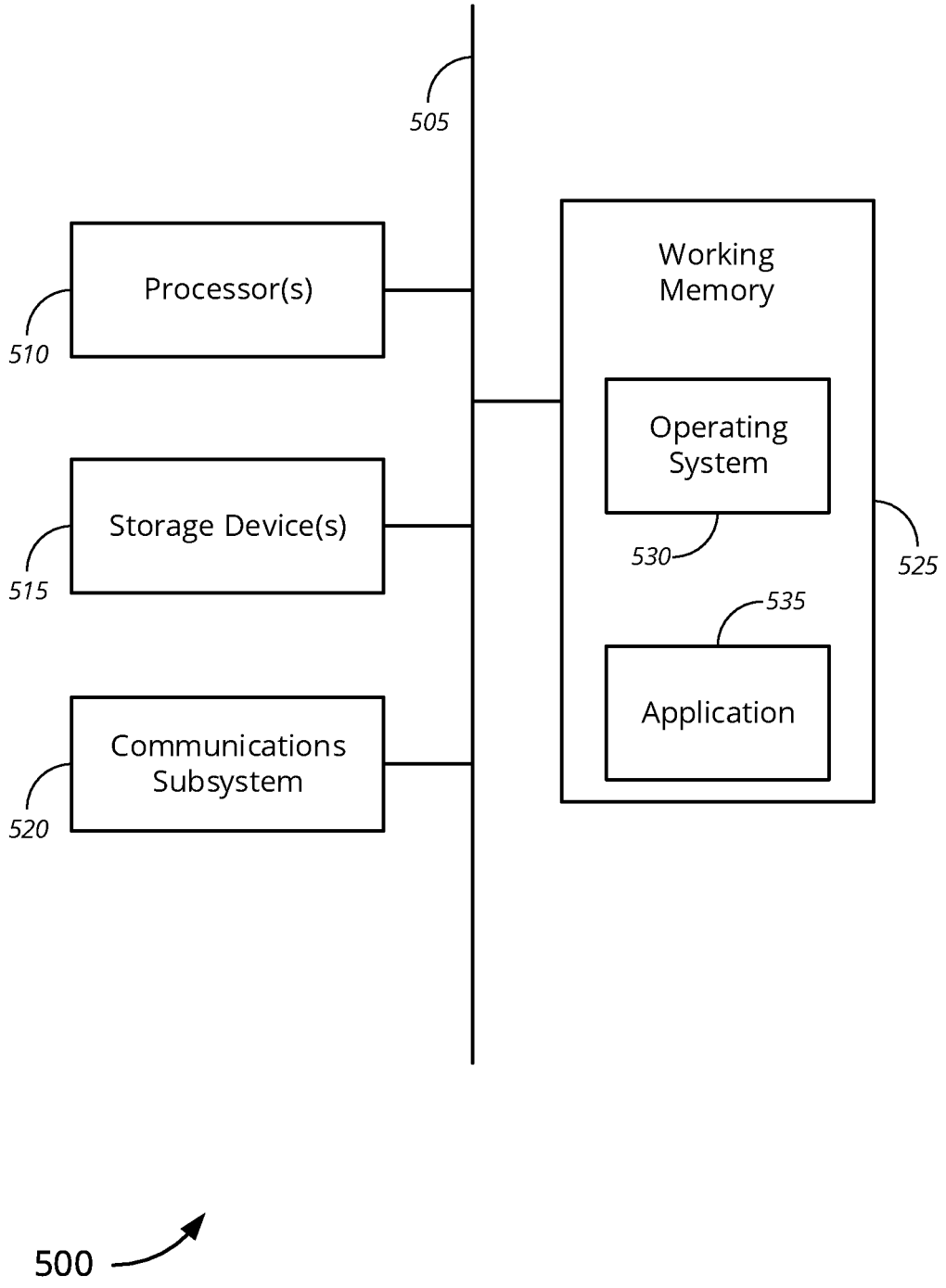
FIG. 5 is a schematic block diagram of computer hardware for a dynamic compaction controller, in accordance with various embodiments.

FIG. 5 is a schematic block diagram of computer hardware for a dynamic compaction controller, in accordance with various embodiments. FIG. 5 provides a schematic illustration of one embodiment of a computer system 500 that can perform the methods provided by various other embodiments, as described herein, and/or can perform the functions of a compaction controller, remote management systems, off-site post-processing systems, or any other computer systems as described above. It should be noted that FIG. 5 is meant only to provide a generalized illustration of various components, of which one or more (or none) of each may be utilized as appropriate. FIG. 5, therefore, broadly illustrates how individual system elements may be implemented in a relatively separated or integrated manner.

The computer system 500 includes a plurality of hardware elements that can be electrically coupled via a bus 505 (or may otherwise be in communication, as appropriate). The hardware elements may include one or more processors 510, including, without limitation, one or more general-purpose processors and/or one or more special-purpose processors (such as digital signal processing chips, graphics acceleration processors, and/or the like). In general, embodiments can employ as a processor any device, or combination of devices, that can operate to execute instructions to perform functions as described herein. Merely by way of example, and without limitation, any microprocessor (also sometimes referred to as a central processing unit, or "CPU") can be used as a processor, including without limitation one or more complex instruction set computing ("CISC") microprocessors, such as the single core and multicore processors available from Intel Corporation™ and others, such as Intel's X86 platform, including, e.g., the Pentium™, Core™, and Xeon™ lines of processors. Additionally and/or alternatively, reduced instruction set computing ("RISC") microprocessors, such as the IBM Power™ line of processors, processors employing chip designs by ARM Holdings™, and others can be used in many embodiments. In further embodiments, a processor might be a microcontroller, embedded processor, embedded system, system on a chip ("SoC") or the like.

As used herein, the term "processor" can mean a single processor or processor core (of any type) or a plurality of processors or processor cores (again, of any type) operating individually or in concert. Merely by way of example, the computer system 500 might include a general-purpose processor having multiple cores, a digital signal processor, and a graphics acceleration processor. In other cases, the computer system might 500 might include a CPU for general purpose tasks and one or more embedded systems or microcontrollers, for example, to run real-time functions. The functionality described herein can be allocated among the various processors or processor cores as needed for specific implementations. Thus, it should be noted that, while various examples of processors 510 have been described herein for illustrative purposes, these examples should not be considered limiting.

The computer system 500 may further include, or be in communication with, one or more storage devices 515. The one or more storage devices 515 can comprise, without limitation, local and/or network accessible storage, or can include, without limitation, a disk drive, a drive array, an optical storage device, a solid-state drive, flash-based storage, or other solid-state storage device. The solid-state storage device can include, but is not limited to, one or more of a random access memory ("RAM") or a read-only memory ("ROM"), which can be programmable, flash-updateable, or the like. Such storage devices may be configured to implement any appropriate data stores, including, without limitation, various file systems, database structures, or the like.

The computer system 500 might also include a communications subsystem 520, which can include, without limitation, a modem, a network card (wireless or wired), a wireless programmable radio, or a wireless communication device. Wireless communication devices may further include, without limitation, a Bluetooth device, an 802.11 device, a WiFi device, a WiMax device, a WWAN device, cellular communication facilities, or the like. The communications subsystem 520 may permit data to be exchanged with a customer premises, residential gateway, authentication server, a customer facing cloud server, network orchestrator, host machine servers, other network elements, or combination of the above devices, as described above. Communications subsystem 520 may also permit data to be exchanged with other computer systems, and/or with any other devices described herein, or with any combination of network, systems, and devices. According to some embodiments, the network might include a local area network ("LAN"), including without limitation a fiber network, or an Ethernet network; a wide-area network ("WAN"); a wireless wide area network ("WWAN"); a virtual network, such as a virtual private network ("VPN"); the Internet; an intranet; an extranet; a public switched telephone network ("PSTN"); an infra-red network; a wireless network, including without limitation a network operating under any of the IEEE 802.11 suite of protocols, the Bluetooth protocol, or any other wireless protocol; or any combination of these or other networks.

In many embodiments, the computer system 500 will further comprise a working memory 525, which can include a RAM or ROM device, as described above. The computer system 500 also may comprise software elements, shown as being currently located within the working memory 525, including an operating system 530, device drivers, executable libraries, and/or other code. The software elements may include one or more application programs 535, which may comprise computer programs provided by various embodiments, and/or may be designed to implement methods and/or configure systems provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be encoded and/or stored on a non-transitory computer readable storage medium, such as the storage device(s) 525 described above. In some cases, the storage medium might be incorporated within a computer system, such as the system 500. In other embodiments, the storage medium might be separate from a computer system (i.e., a removable medium, such as a compact disc, etc.), and/or provided in an installation package, such that the storage medium can be used to program, configure and/or adapt a general purpose computer with the instructions/code stored thereon. These instructions might take the form of executable code, which is executable by the computer system 500 and/or might take the form of source and/or installable code, which, upon compilation and/or installation on the computer system 500 (e.g., using any of a variety of generally available compilers, installation programs, compression/decompression utilities, etc.) then takes the form of executable code.

It will be apparent to those skilled in the art that substantial variations may be made in accordance with specific requirements. For example, customized hardware (such as programmable logic controllers, field-programmable gate arrays, application-specific integrated circuits, and/or the like) might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 500) to perform methods in accordance with various embodiments of the invention. According to a set of embodiments, some or all of the procedures of such methods are performed by the computer system 500 in response to processor 510 executing one or more sequences of one or more instructions (which might be incorporated into the operating system 530 and/or other code, such as an application program 535) contained in the working memory 525. Such instructions may be read into the working memory 525 from another computer readable medium, such as one or more of the storage device(s) 515. Merely by way of example, execution of the sequences of instructions contained in the working memory 525 might cause the processor(s) 510 to perform one or more procedures of the methods described herein.

The terms "machine readable medium" and "computer readable medium," as used herein, refer to any medium that participates in providing data that causes a machine to operation in a specific fashion. In an embodiment implemented using the computer system 500, various computer readable media might be involved in providing instructions/code to processor(s) 510 for execution and/or might be used to store and/or carry such instructions/code (e.g., as signals). In many implementations, a computer readable medium is a non-transitory, physical and/or tangible storage medium. In some embodiments, a computer readable medium may take many forms, including but not limited to, non-volatile media, volatile media, or the like. Non-volatile media includes, for example, optical and/or magnetic disks, such as the storage device(s) 515. Volatile media includes, without limitation, dynamic memory, such as the working memory 525.

Common forms of physical and/or tangible computer readable media include, for example, a floppy disk, a flexible disk, a hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read instructions and/or code.

Various forms of computer readable media may be involved in carrying one or more sequences of one or more instructions to the processor(s) 510 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 500. These signals, which might be in the form of electromagnetic signals, acoustic signals, optical signals and/or the like, are all examples of carrier waves on which instructions can be encoded, in accordance with various embodiments of the invention.

The communications subsystem 520 (and/or components thereof) generally will receive the signals, and the bus 505 then might carry the signals (and/or the data, instructions, etc. carried by the signals) to the processor(s) 510, or working memory 525, from which the processor(s) 510 retrieves and executes the instructions. The instructions received by the working memory 525 may optionally be stored on a storage device 515 either before or after execution by the processor(s) 510.

According to a set of embodiments, the computer system 500 may be a compaction controller having access to, and in communication with, each of an at least one positional sensor, at least one boom deflection sensor, rotational encoder, and pressure sensor. The dynamic compaction controller 500 may be able to directly or indirectly communicate with each of the sensor components via the communications subsystem 520. In some further embodiments, the sensor components may be able to provide measurements directly to the bus 505 for direct access by the one or more processor 510.

According to one set of embodiments, the dynamic compaction controller 500 may include an at least one processor 510, and non-transitory computer readable media 515, 525 having encoded thereon computer software 535 comprising a set of instructions executable by the at least one processor 510 to perform various operations. In one set of embodiments, the software application 535 may include instructions executable to identify a first drop location from plurality of drop locations, the first drop location associated with a first target parameter. In various embodiments, the plurality of drop locations may be received, via the communications subsystem 520, from a dynamic compaction plan that was created remotely. The software 535 may further include instructions to determine, via the at least one positional sensor, whether at least one of a distal end or a compaction weight is positioned over the first drop location. The compaction controller 500 may further determine, via the rotational encoder, an initial elevation of the compaction weight at rest at the first drop location. The compaction controller 500 may further cause the compaction crane to lift, via a winch cable, the compaction weight to a drop height associated with the first drop location. Based on measurements from at least one of the at least one boom deflection sensor or pressure sensor, the compaction controller may detect when the compaction weight has been released. After being released, the compaction weight may be re-hoist to the drop height for a subsequent drop. The, the rotational encoder may be utilized to measure or determine a payout length of the winch cable when the compaction weight initially lifts off the ground. The compaction controller 500 may then determine a current elevation of the compaction weight based at least in part on the payout length of the winch cable. Finally, the compaction controller may determine whether the first target parameter is satisfied.

In another set of embodiments, the set of instructions 535 may further include instructions executable by the at least one processor 510 to identify, via the pressure sensor, when the compaction weight initially lifts off the ground based on a line pressure of the hydraulic line. The lift-off point may similarly be identify, via the at least one boom deflection sensor, based on the boom deflection of the distal end. Then, based on both the hydraulic line pressure and boom deflection, a trigger point may be determined from which to determine the current elevation of the compaction weight.

In some further embodiments, the compaction controller 500 may further determine the boom deflection as a vertical displacement of the distal end of the boom. A distal end elevation may further be determined at a trigger point, when the distal end has been deflected. A total drop count may further be determined based on a total number of completed drops. Thus, the instructions may further allow the compaction controller 500 to determine whether a lift cycle has been completed for the compaction weight and the current elevation of the compaction weight is lower than the initial measured elevation.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A system for dynamic compaction comprising:

a compaction crane comprising:

a boom having a proximal end and a distal end, the boom operatively coupled to a housing assembly at the proximal end;

a compaction weight coupled to the distal end of the boom via a winch cable;

at least one positional sensor operatively coupled to the compaction crane to determine at least a position of the distal end of the boom;

at least one boom deflection sensor operatively coupled to the distal end of the boom to determine at least a boom deflection of the distal end;

a rotational encoder tracking a payout length of the winch cable;

a pressure sensor communicatively coupled to a hydraulic line of a boom lifting system;

a compaction control system in communication with each of the at least one positional sensor, the at least one boom deflection sensor, the rotational encoder, and the pressure sensor, the compaction control system further comprising:

at least one processor;

non-transitory computer readable media having encoded thereon computer software comprising a set of instructions executable by the at least one processor to:

identify a first drop location of a plurality of drop locations, the first drop location associated with a first target parameter;

determine, via the at least one positional sensor, whether at least one of the distal end of the boom or the compaction weight is positioned over the first drop location;

determine, via the rotational encoder, an initial elevation of the compaction weight at rest at the first drop location;

lift, via the winch cable, the compaction weight to a drop height associated with the first drop location;

detect, via at least one of the at least one boom deflection sensor or pressure sensor, that the compaction weight has been released;

re-hoist, via the winch cable, the compaction weight to the drop height;

measure, via the rotational encoder, the payout length of the winch cable when the compaction weight initially lifts off the ground;

determine a current elevation of the compaction weight based at least in part on the payout length of the winch cable; and determine whether the first target parameter is satisfied, based at least in part on the current elevation of the compaction weight.

2. The system of claim 1 further comprising a site gateway communicatively coupled to the compaction control system, the site gateway connecting the compaction control system to a communications network, wherein the compaction control system further includes instructions executable by the at least one processor to:

receive at least one updated dynamic compaction plan parameter, wherein the at least one updated dynamic compaction plan parameter effects a change to at least one of the first target parameter, or a position of at least one of the plurality of drop locations; and transmit at least one of the position of the distal end of the boom, the boom deflection of the distal end, a distal end elevation, the payout length of the winch cable, or a line pressure of the hydraulic line.

3. The system of claim 1, wherein the rotational encoder is a friction drive depth sensor operatively coupled to a winch wheel around which the winch cable is wound.

4. The system of claim 1 further comprising at least one global navigation satellite system receiver, wherein the at least one global navigation satellite system receiver further comprises the at least one positional sensor and the at least one boom deflection sensor, the at least one global navigation satellite system receiver in communication with at least one global navigation satellite system antenna operatively coupled to the housing assembly of the compaction crane, and at least one global navigation satellite system antenna operatively coupled to the distal end of the boom.

5. The system of claim 1, wherein the compaction control system further includes instructions executable by the at least one processor to:

identify, via the pressure sensor, when the compaction weight initially lifts off the ground based on a line pressure of the hydraulic line;

determine, based at least in part on the line pressure, a trigger point to measure the payout length from which the current elevation of the compaction weight is determined.

6. The system of claim 1, wherein the compaction control system further includes instructions executable by the at least one processor to:

identify, via the at least one boom deflection sensor, when the compaction weight initially lifts off the ground based on the boom deflection of the distal end;

determine, based at least in part on the boom deflection, a trigger point to measure the payout length from which the current elevation of the compaction weight is determined;

determine, via the at least one boom deflection sensor, the boom deflection, wherein the boom deflection indicates an amount of vertical displacement of the distal end of the boom; and determine, via the at least one positional sensor, a distal end elevation at the trigger point.

7. The system of claim 1, wherein the compaction control system further includes instructions executable by the at least one processor to:

determine a total drop count of compaction weight drops, wherein a compaction weight drop is only counted when a lift cycle has been completed for the compaction weight and the current elevation of the compaction weight is lower than the initial elevation.

8. The system of claim 7, wherein a compaction weight drop is only counted when further the drop height exceeds a threshold value above the initial elevation.

9. The system of claim 1, wherein the compaction control system further includes instructions executable by the at least one processor to:

determine, based at least in part on the current elevation of the compaction weight, a second compaction weight of a plurality of compaction weights to use in a subsequent drop; and identify, via at least one of the pressure sensor or the at least one boom deflection sensor, which of the plurality of compaction weights is being hoisted.

10. The system of claim 1, wherein the compaction control system further includes instructions executable by the at least one processor to:

automatically navigate, based on the at least one positional sensor, the compaction crane to a location proximate to the first drop location; and automatically position, via the housing assembly and boom lifting system, the distal end of the boom over the first drop location.

11. The system of claim 1, wherein the target parameter includes at least one of a minimum drop count, maximum drop count, total drop count, drop-to-drop elevation change, target elevation, or total elevation change.

12. The system of claim 1, wherein the initial and current elevations are measured from one of a top surface or bottom surface of the compaction weight.

13. A dynamic compaction controller in communication with at least one positional sensor, at least one boom deflection sensor, a rotational encoder, and a pressure sensor, the dynamic compaction controller further comprising:

at least one processor;

non-transitory computer readable media having encoded thereon computer software comprising a set of instructions executable by the at least one processor to:

identify a first drop location of a plurality of drop locations, the first drop location associated with a first target parameter;

determine, via the at least one positional sensor, whether at least one of a compaction weight or a distal end of a boom of a compaction crane holding the compaction weight is positioned over the first drop location;

determine, via the rotational encoder, an initial elevation of the compaction weight at rest at the first drop location;

lift, via a winch cable, the compaction weight to a drop height associated with the first drop location;

detect, via at least one of the at least one boom deflection sensor or pressure sensor, that the compaction weight has been released;

re-hoist, via the winch cable, the compaction weight to the drop height;

measure, via the rotational encoder, the payout length of the winch cable when the compaction weight initially lifts off the ground;

determine a current elevation of the compaction weight based at least in part on the payout length of the winch cable; and determine whether the first target parameter is satisfied, based at least in part on the current elevation of the compaction weight.

14. The controller of claim 13, wherein the set of instructions further includes instructions executable by the at least one processor to:

identify, via the pressure sensor, when the compaction weight initially lifts off the ground based on a line pressure of the hydraulic line;

determine, based at least in part on the line pressure, a trigger point to measure the payout length from which the current elevation of the compaction weight is determined.

15. The controller of claim 13, wherein the set of instructions further includes instructions executable by the at least one processor to:

identify, via the at least one boom deflection sensor, when the compaction weight initially lifts off the ground based on the boom deflection of the distal end;

determine, based at least in part on the boom deflection, a trigger point to measure the payout length from which the current elevation of the compaction weight is determined;

determine, via the at least one boom deflection sensor, the boom deflection, wherein the boom deflection indicates an amount of vertical displacement of the distal end of the boom; and determine, via the at least one positional sensor, a distal end elevation at the trigger point.

16. The controller of claim 13, wherein the set of instructions further includes instructions executable by the at least one processor to:

determine a total drop count of compaction weight drops, wherein a compaction weight drop is only counted when a lift cycle has been completed for the compaction weight and the current elevation of the compaction weight is lower than the initial elevation.

17. A method for dynamic compaction comprising:

identifying, via a dynamic compaction controller, a first drop location of a plurality of drop locations, the first drop location associated with a first target parameter;

determining, via at least one positional sensor, whether at least one of a compaction weight or a distal end of a boom of a compaction crane is positioned over the first drop location, wherein the distal end of the boom hoists the compaction weight via a winch cable;

determining, via a rotational encoder, an initial elevation of the compaction weight at rest at the first drop location;

lifting, via the winch cable, the compaction weight to a drop height defined for the first drop location;

detecting, via at least one of a pressure sensor or an at least one boom deflection sensor, that the compaction weight has been released;

re-hoisting, via the winch cable, the compaction weight to the drop height;

measuring, via the rotational encoder, a payout length of the winch cable when the compaction weight initially lifts off the ground;

determining, via the dynamic compaction controller, a current elevation of the compaction weight based at least in part on the payout length of the winch cable; and determining, via the dynamic compaction controller, whether the first target parameter is satisfied, based at least in part on the current elevation of the compaction weight.

18. The method of claim 17 further comprising:

identifying, via the pressure sensor, when the compaction weight initially lifts off the ground based on a line pressure of a hydraulic line of a boom lifting system; and determining, based at least in part on the line pressure, a trigger point to measure the payout length from which the current elevation of the compaction weight is determined.

19. The method of claim 17 further comprising:

identifying, via the at least one boom deflection sensor, when the compaction weight initially lifts off the ground based on a boom deflection;

determining, based at least in part on the boom deflection, a trigger point to measure the payout length from which the current elevation of the compaction weight is determine;

determining, via the at least one boom deflection sensor, the boom deflection, wherein the boom deflection indicates an amount of vertical displacement of the distal end of the boom; and determining, via the at least one positional sensor, a distal end elevation at the trigger point.

20. The method of claim 17 further comprising:

determining, via the dynamic compaction controller, a total drop count of compaction weight drops, wherein a compaction weight drop is only counted when a lift cycle has been completed for the compaction weight and the current elevation of the compaction weight is lower than the initial elevation.

* * * * *